US007366660B2

(12) United States Patent
Kondo et al.

(10) Patent No.: US 7,366,660 B2
(45) Date of Patent: Apr. 29, 2008

(54) TRANSMISSION APPARATUS, TRANSMISSION METHOD, RECEPTION APPARATUS, RECEPTION METHOD, AND TRANSMISSION/RECEPTION APPARATUS

(75) Inventors: Tetsujiro Kondo, Tokyo (JP); Masaaki Hattori, Chiba (JP); Tsutomu Watanabe, Kanagawa (JP); Hiroto Kimura, Tokyo (JP)

(73) Assignee: Sony Corporation, Tokyo (JP)

( * ) Notice: Subject to any disclaimer, the term of this patent is extended or adjusted under 35 U.S.C. 154(b) by 786 days.

(21) Appl. No.: 10/362,582

(22) PCT Filed: Jun. 20, 2002

(86) PCT No.: PCT/JP02/06179

§ 371 (c)(1),
(2), (4) Date: Aug. 7, 2003

(87) PCT Pub. No.: WO03/001709

PCT Pub. Date: Jan. 3, 2003

(65) Prior Publication Data

US 2004/0024589 A1 Feb. 5, 2004

(30) Foreign Application Priority Data

Jun. 26, 2001 (JP) ..... 2001-192379

(51) Int. Cl.
*G10L 19/04* (2006.01)

(52) U.S. Cl. ..... 704/219; 704/201

(58) Field of Classification Search ..... None
See application file for complete search history.

(56) References Cited

U.S. PATENT DOCUMENTS 5,432,883 A * 7/1995 Yoshihara ..... 704/219

(Continued)

FOREIGN PATENT DOCUMENTS

EP 0 891 101 1/1999

(Continued)

OTHER PUBLICATIONS

Gersho A et al.: "Adaptive Vector Quantization by Progressive Codevector Replacement" International Conference on Acoustics, Speech & Signal Processing. ICASSP. Tampa, Florida, Mar. 26-29, 1985, New York, IEEE, US, vol. 1 Conf. 10, Mar. 26, 1985, pp. 133-136, XP001176990.

(Continued)

*Primary Examiner*—Abul K. Azad
(74) *Attorney, Agent, or Firm*—Frommer Lawrence & Haug LLP; William S. Frommer; Thomas F. Presson

(57) ABSTRACT

The present invention relates to a transceiver which provides a high-quality decoded voice. A mobile telephone $\mathbf{101}_1$ encodes voice data, and outputs the encoded voice data. Furthermore, the mobile telephone $\mathbf{101}_1$ learns quality-enhancement data which improves the quality of a voice output from a mobile telephone $\mathbf{101}_2$, based on voice data used in past learning and newly input voice data, thereby transmitting the encoded voice data and quality-enhancement data. The mobile telephone $\mathbf{101}_2$ receives the encoded voice data transmitted from the mobile telephone $\mathbf{101}_1$, and selects quality-enhancement data correspondingly associated with a telephone number of the mobile telephone $\mathbf{101}_1$. The mobile telephone $\mathbf{101}_2$ decodes the received encoded voice data based on the selected quality-enhancement data. The present invention is applied to a mobile telephone that transmits and receives voices.

8 Claims, 26 Drawing Sheets

U.S. PATENT DOCUMENTS

| | | | | |
|---|---|---|---|---|
| 5,819,213 | A * | 10/1998 | Oshikiri et al. | 704/222 |
| 6,160,845 | A | 12/2000 | Kondo et al. | |
| 6,339,615 | B1 | 1/2002 | Kondo et al. | |
| 6,650,762 | B2 * | 11/2003 | Gibson et al. | 382/100 |
| 6,658,378 | B1 * | 12/2003 | Maeda | 704/200.1 |
| 6,704,702 | B2 * | 3/2004 | Oshikiri et al. | 704/207 |
| 6,704,711 | B2 * | 3/2004 | Gustafsson et al. | 704/258 |

FOREIGN PATENT DOCUMENTS

| | | |
|---|---|---|
| JP | 10-105197 | 4/1998 |
| JP | 10-243406 | 9/1998 |
| JP | 2000-132196 | 5/2000 |
| JP | 2002-123299 | 4/2002 |
| WO | WO 98/30028 | 7/1998 |
| WO | WO 00/67091 | 11/2000 |
| WO | WO 02/13183 | 2/2002 |

OTHER PUBLICATIONS

Pettigrew R et al.: "Backward Pitch Prediction for Low-Delay Speech Coding" Communications Technology for the 1990's and Beyond. Dallas, Nov. 27-30, 1989, Proceedings of the Global Telecommunications Conference and Exhibition (Globecom), New York, IEEE, US, vol. 2, Nov. 27, 1989, pp. 1247-1252, XP000091211.

* cited by examiner

TRANSMISSION APPARATUS, TRANSMISSION METHOD, RECEPTION APPARATUS, RECEPTION METHOD, AND TRANSMISSION/RECEPTION APPARATUS

TECHNICAL FIELD

The present invention relates to a transmitter, transmitting method, receiver, receiving method, and transceiver and, more particularly to a transmitter, transmitting method, receiver, receiving method, and transceiver for permitting users to communicate with a high-pitched voice over mobile telephones.

BACKGROUND ART

Since transmission bandwidth is limited in a voice communication over mobile telephones, the quality of a received voice is significantly degraded from the quality of the voice actually spoken by a user.

To improve the quality of the received voice, conventional mobile telephones perform signal processing on the received voice, such as a filtering for adjusting the frequency spectrum of the voice.

Each user has his or her own unique feature in voice. If the received voice is subjected to a filtering operation having the same tap coefficient, the quality of the voice is not sufficiently improved depending on different voice frequency characteristics of users.

DISCLOSURE OF INVENTION

The present invention has been developed in view of the above problem, and it is an object of the present invention to obtain a voice quality improved taking into account each user's voice feature.

A transmitter of the present invention includes encoder means which encodes the voice data and outputs encoded voice data, learning means which learns quality-enhancement data that improves the quality of a voice output on a receiving side that receives the encoded voice data, based on voice data that is used in past learning and newly input voice data, and transmitter means which transmits the encoded voice data and the quality-enhancement data.

A transmitting method of the present invention includes an encoding step of encoding the voice data and outputting the encoded voice data, a learning step of learning quality-enhancement data that improves the quality of a voice output on a receiving side that receives the encoded voice data, based on voice data that is used in past learning and newly input voice data, and a transmitting step of transmitting the encoded voice data and the quality-enhancement data.

A first computer program of the present invention includes an encoding step of encoding the voice data and outputting the encoded voice data, a learning step of learning quality-enhancement data that improves the quality of a voice output on a receiving side that receives the encoded voice data, based on voice data that is used in past learning and newly input voice data, and a transmitting step of transmitting the encoded voice data and the quality-enhancement data.

A first storage medium of the present invention stores a computer program, and the computer program includes an encoding step of encoding the voice data and outputting the encoded voice data, a learning step of learning quality-enhancement data that improves the quality of a voice output on a receiving side that receives the encoded voice data, based on voice data that is used in past learning and newly input voice data, and a transmitting step of transmitting the encoded voice data and the quality-enhancement data.

A receiver of the present invention includes receiver means which receives the encoded voice data, storage means which stores quality-enhancement data, which improves decoded voice data that is obtained by decoding the encoded voice data, together with identification information that identifies a transmitting side that has transmitted the encoded voice data, selector means which selects the quality-enhancement data that is correspondingly associated with the identification information of the transmitting side that has transmitted the encoded voice data, and decoder means which decodes the encoded voice data that is received by the receiver means, based on the quality-enhancement data selected by the selector means.

A receiving method of the present invention includes a receiving step of receiving the encoded voice data, a storing step of storing quality-enhancement data, which improves decoded voice data that is obtained by decoding the encoded voice data, together with identification information that identifies a transmitting side that has transmitted the encoded voice data, a selecting step of selecting the quality-enhancement data that is correspondingly associated with the identification information of the transmitting side that has transmitted the encoded voice data, and a decoding step of decoding the encoded voice data that is received in the receiving step, based on the quality-enhancement data selected in the selecting step.

A second computer program of the present invention includes a receiving step of receiving the encoded voice data, a storing step of storing quality-enhancement data, which improves decoded voice data that is obtained by decoding the encoded voice data, together with identification information that identifies a transmitting side that has transmitted the encoded voice data, a selecting step of selecting the quality-enhancement data that is correspondingly associated with the identification information of the transmitting side that has transmitted the encoded voice data, and a decoding step of decoding the encoded voice data that is received in the receiving step, based on the quality-enhancement data selected in the selecting step.

A second storage medium of the present invention stores a computer program, and the computer program includes a receiving step of receiving encoded voice data, a storing step of storing quality-enhancement data, which improves decoded voice data that is obtained by decoding the encoded voice data, together with identification information that identifies a transmitting side that has transmitted the encoded voice data, a selecting step of selecting the quality-enhancement data that is correspondingly associated with the identification information of the transmitting side that has transmitted the encoded voice data, and a decoding step of decoding the encoded voice data that is received in the receiving step, based on the quality-enhancement data selected in the selecting step.

A transceiver of the present invention includes encoder means which encodes input voice data and outputs encoded voice data, learning means which learns quality-enhancement data that improves the quality of a voice output on another transceiver that receives the encoded voice data, based on voice data that is used in past learning and newly input voice data, transmitter means which transmits the encoded voice data and the quality-enhancement data, receiver means which receives the encoded voice data transmitted from the other transceiver, storage means which stores the quality-enhancement data together with identification information that identifies the other transceiver that has transmitted the encoded voice data, selector means which selects the quality-enhancement data that is correspondingly associated with the identification information of the other transceiver that has transmitted the encoded voice data, and decoder means which decodes the encoded voice data that is received by the receiver means, based on the quality-enhancement data selected by the selector means.

In the transmitter, the transmitting method, and the first computer program in accordance with the present invention, the voice data is encoded, and the encoded voice data is output. The quality-enhancement data, which improves the quality of the voice output on the receiving side that receives the encoded voice data, is learned based on the voice data used in the past learning and the newly input voice data. The encoded voice data and the quality-enhancement data are then transmitted.

In the receiver, the receiving method, and the first computer program in accordance with the present invention, the encoded voice data is received, and the quality-enhancement data correspondingly associated with the identification information of the transmitting side that has transmitted the encoded voice data is selected. Based on the selected quality-enhancement data, the received encoded voice data is decoded.

In the transceiver, the input voice data is encoded, and the encoded voice data is output. The quality-enhancement data, which improves the quality of the voice output on the other transceiver that receives the encoded voice data, is learned based on the voice data used in the past learning and the newly input voice data. The encoded voice data and the quality-enhancement data are then transmitted. The encoded voice data transmitted from the other transceiver is received. The quality-enhancement data correspondingly associated with the identification information of the other transceiver that has transmitted the encoded voice data is selected. Based on the selected quality-enhancement data, the received encoded voice data is decoded.

BEST MODE FOR CARRYING OUT THE INVENTION

Figure 1:
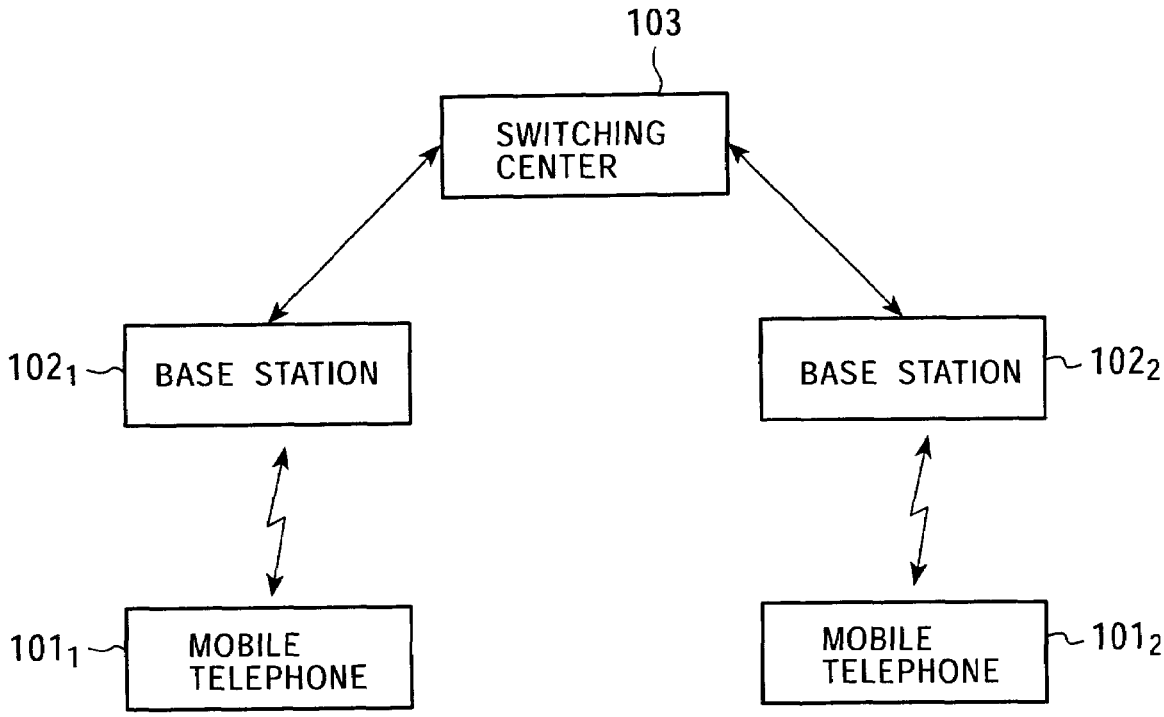
FIG. 1 is a block diagram illustrating one embodiment of a transmission system implementing the present invention.

FIG. 1 illustrates one embodiment of a transmission system implementing the present invention (the system refers to a set of a plurality of logically linked apparatuses and whether or not the construction of each apparatus is actually contained in a single housing is not important).

In this transmission system, mobile telephones $\mathbf{101}_1$ and $\mathbf{101}_2$ respectively radio communicate with base stations $\mathbf{102}_1$ and $\mathbf{102}_2$. The base stations $\mathbf{102}_1$ and $\mathbf{102}_2$ respectively communicate with a switching center 103. Voice communication is thus performed between the mobile telephones $\mathbf{101}_1$ and $\mathbf{101}_2$ through the base stations $\mathbf{102}_1$ and $\mathbf{102}_2$ and the switching center 103. The base stations $\mathbf{102}_1$ and $\mathbf{102}_2$ can be the same single base station or different base stations.

Each of the mobile telephones $\mathbf{101}_1$ and $\mathbf{101}_2$ is represented by a mobile telephone 101 in the following discussion unless necessary.

Figure 2:
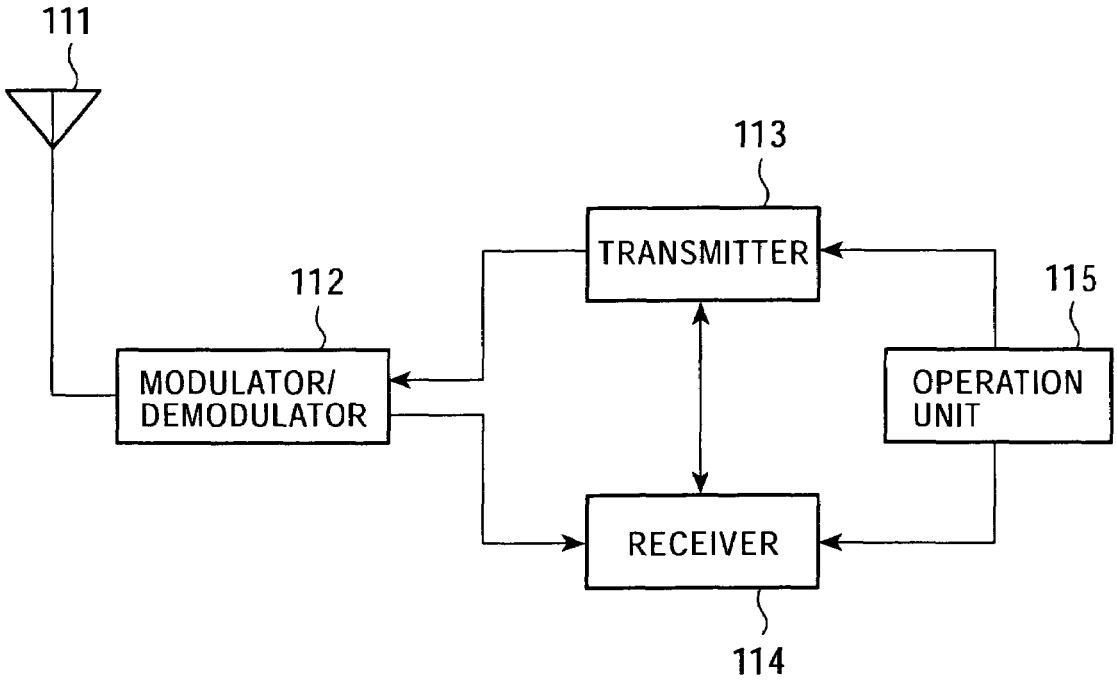
FIG. 2 is a block diagram illustrating the construction of a mobile telephone 101.

FIG. 2 illustrates the construction of the mobile telephone $\mathbf{101}_1$ of FIG. 1. Since the mobile telephone $\mathbf{101}_2$ has the same construction as that of the mobile telephone $\mathbf{101}_1$, the discussion of the construction thereof is skipped.

An antenna 111 receives radio waves from one of the mobile telephones $\mathbf{102}_1$ and $\mathbf{102}_2$, and supplies a modulator/demodulator 112 with received signals. The antenna 111 transmits a signal from the modulator/demodulator 112 in the form of radio wave to one of the mobile telephones $\mathbf{102}_1$ and $\mathbf{102}_2$. The modulator/demodulator 112 demodulates a signal from the antenna 111 using a CDMA (Code Division Multiple Access) method, and supplies a receiver 114 with the resulting demodulated signal. The modulator/demodulator 112 modulates transmission data supplied from a transmitter 113 using the CDMA method, and then supplies the antenna 111 with the resulting modulated signal. The transmitter 113 performs a predetermined process such as encoding the voice of a user, and supplies the modulator/demodulator 112 with the resulting transmission data. The receiver 114 receives the data, i.e., a demodulated signal from the modulator/demodulator 112, and decodes the signal into a high-pitched voice.

The user inputs a calling telephone number or a predetermined command by operating an operation unit 115. An operation signal in response to an input operation is fed to the transmitter 113 and the receiver 114.

Information is exchanged as necessary between the transmitter 113 and the receiver 114.

Figure 3:
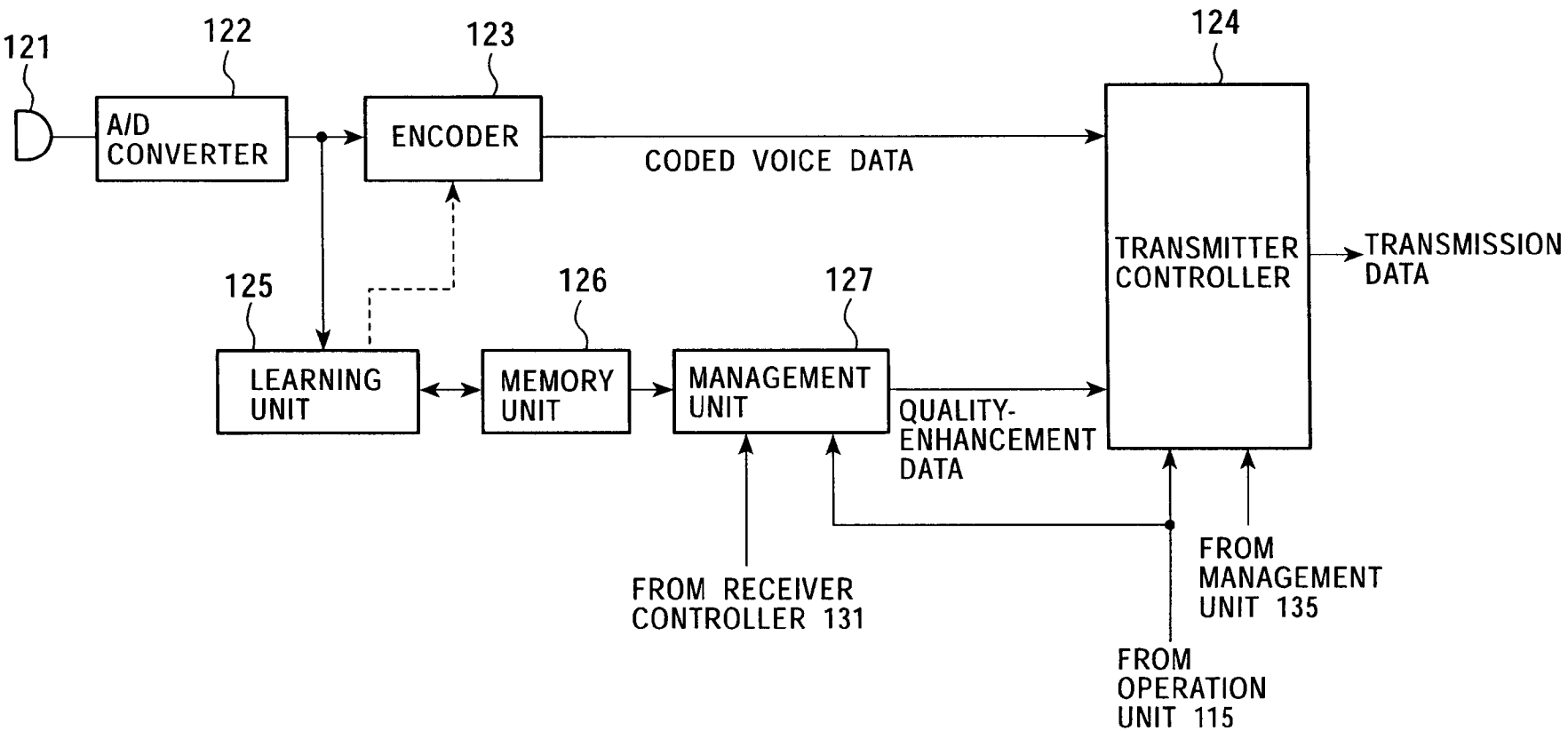
FIG. 3 is a block diagram illustrating the construction of a transmitter 113.

FIG. 3 illustrates the construction of the transmitter 113 shown in FIG. 2.

A microphone 121 receives the voice of the user, and outputs a voice signal of the user as an electrical signal to an A/D (Analog/Digital) converter 122. The A/D converter 122 analog-to-digital converts the analog voice signal from the microphone 121 into digital voice data, and outputs the digital voice data to an encoder 123 and a learning unit 125.

The encoder 123 encodes the voice data from the A/D converter 122 using a predetermined encoding method, and outputs the resulting encoded voice data S1 to a transmitter controller 124.

The transmitter controller 124 controls the transmission of the encoded voice data output by the encoder 123 and quality-enhancement data output by an management unit 127 to be discussed later. Specifically, the transmitter controller 124 selects one of the encoded voice data output by the encoder 123 and quality-enhancement data output by the management unit 127 to be discussed later, etc., and outputs the selected data to the modulator/demodulator 112 (FIG. 2) at a predetermined transmission timing. As necessary, the transmitter controller 124 outputs, as transmission data, a called telephone number, a calling telephone number of the calling side, and other necessary information, input when the user operates the operation unit 115, besides the encoded voice data and the quality-enhancement data.

The learning unit 125 learns the quality-enhancement data that improves the quality of the voice output on a receiving side that receives the encoded voice data output from the encoder 123, based on voice data used in a past learning process and the voice data newly input from the A/D converter 122. Upon obtaining new quality-enhancement data subsequent to the learning process, the learning unit 125 supplies a memory unit 126 with the quality-enhancement data.

The memory unit 126 stores the quality-enhancement data supplied from the learning unit 125.

The management unit 127 manages the quality-enhancement data stored in the memory unit 126, while referencing information supplied from the receiver 114 as necessary.

In the transmitter 113 as discussed above, the voice of the user input to the microphone 121 is supplied to the encoder 123 and the learning unit 125 through the A/D converter 122.

The encoder 123 encodes the voice data input from the A/D converter 122, and outputs the resulting encoded voice data to the transmitter controller 124. The transmitter controller 124 outputs the encoded voice data supplied from the encoder 123 as transmission data to the modulator/demodulator 112 (see FIG. 2).

In the meantime, the learning unit 125 learns the quality-enhancement data based on the voice data used in the past learning process and the voice data newly input from the A/D converter 122, and then feeds the resulting quality-enhancement data to the memory unit 126 for storage there.

In this way, the learning unit 125 learns the quality-enhancement data based on not only the newly input voice data of the user but also the voice data used in the past learning process. As the user talks more over the mobile telephone, the encoded voice data, which is obtained by encoding the voice data of the user, is decoded into higher quality voice data using the quality-enhancement data.

The management unit 127 reads the quality-enhancement data stored in the memory unit 126 at a predetermined timing, and supplies the transmitter controller 124 with the read quality-enhancement data. The transmitter controller 124 outputs the quality-enhancement data from the management unit 127 as the transmission data to the modulator/demodulator 112 (see FIG. 2) at a predetermined transmission timing.

As discussed above, the transmitter 113 transmits the quality-enhancement data besides the encoded voice data as a voice for ordinary communication.

Figure 4:
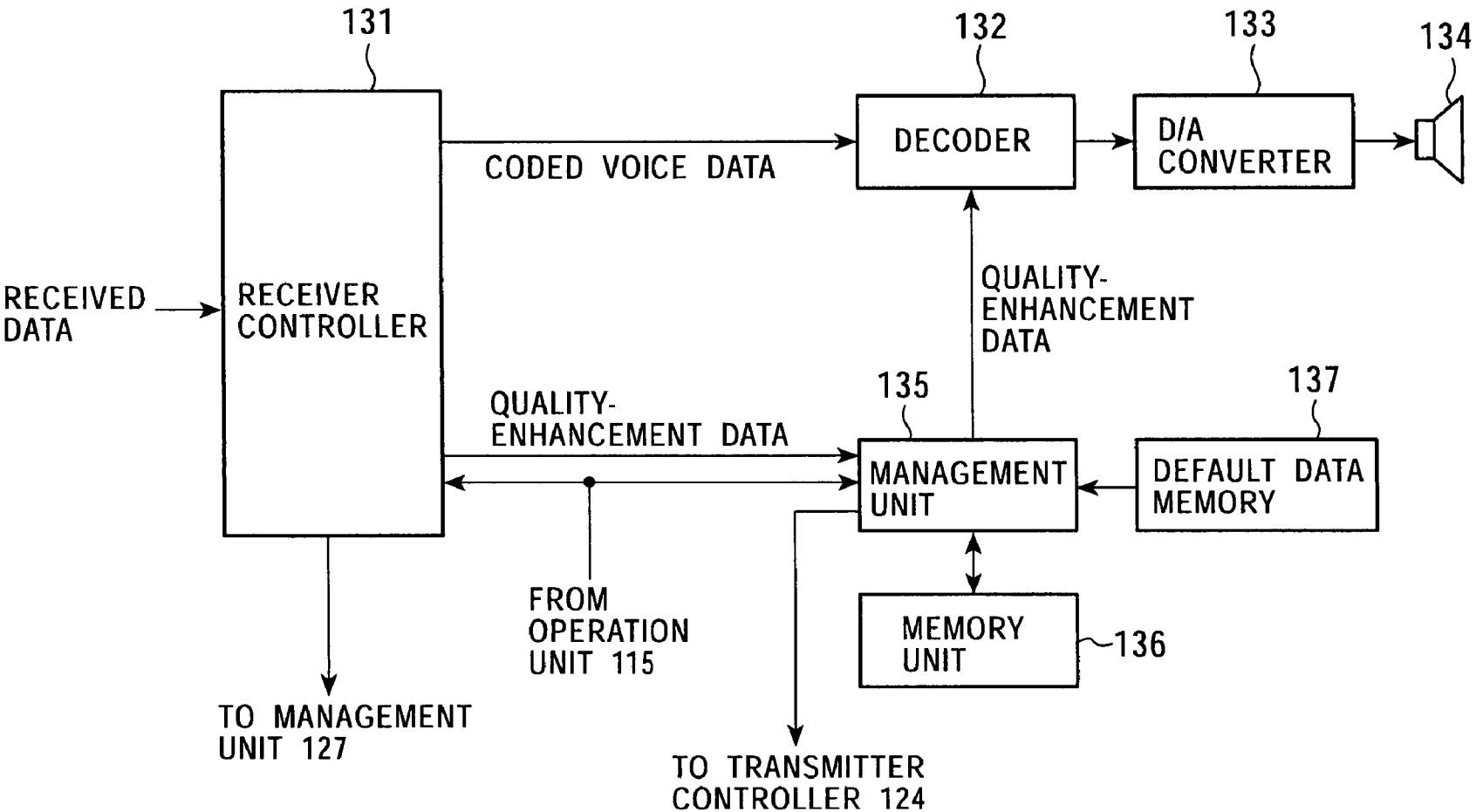
FIG. 4 is a block diagram illustrating the construction of a receiver 114.

FIG. 4 illustrates the construction of the receiver 114 of FIG. 2.

Received data, namely, the demodulated signal output from the modulator/demodulator 112 in FIG. 2, is fed to a receiver controller 131. The receiver controller 131 receives the demodulated signal. If the received data is encoded voice data, the receiver controller 131 feeds the encoded voice data to the decoder 132. If the received data is the quality-enhancement data, the receiver controller 131 feeds the quality-enhancement data to the management unit 135.

The received data contains the calling telephone number and other information besides the encoded voice data and the quality-enhancement data as necessary. The receiver controller 131 feeds these pieces of information to the management unit 135 and (the management unit 127 of) the transmitter 113 as necessary.

The decoder 132 decodes the encoded voice data supplied from the receiver controller 132 using the quality-enhancement data supplied from the management unit 135, resulting in and feeding high-quality voice data to a D/A (Digital/Analog) converter 133.

The D/A converter 133 converts digital-to-analog converts digital voice data output from the decoder 132, and feeds a resulting analog voice signal to a loudspeaker 134. The loudspeaker 134 outputs the voice responsive to the voice signal output from the D/A converter 133.

The management unit 135 manages the quality-enhancement data. Specifically, the management unit 135 receives the calling telephone number from the receiver controller 131 during a call, and selects the quality-enhancement data stored in a memory unit 136 or a default data memory 137 in accordance with the calling telephone number, and feeds the selected quality-enhancement data to the decoder 132. The management unit 135 receives updated quality-enhancement data from the receiver controller 131, and updates the storage content of the memory unit 136 with the updated quality-enhancement data.

The memory unit 136, fabricated of a rewritable EEPROM (Electrically Erasable Programmable Read-Only Memory), stores the quality-enhancement data supplied from the management unit 135. Prior to storage, the quality-enhancement data is correspondingly associated with identification information identifying the calling side that has transmitted the quality-enhancement data, for example, the telephone number of the calling side.

The default data memory 137, fabricated of a ROM, for example, stores beforehand default quality-enhancement data.

As discussed above, the receiver controller 131 in the receiver 114 receives the supplied data at the arrival of a call, and feeds the telephone number of the calling side contained in the received data to the management unit 135. The management unit 135 receives the telephone number of the calling side from the receiver controller 131, and performs a quality-enhancement data setting process for setting the quality-enhancement data to be used in voice communication in accordance with a flow diagram illustrated in FIG. 5.

The quality-enhancement data setting process starts with step S141, in which the management unit 135 searches the memory unit 136 for the telephone number of the calling side. In step S142, the management unit 135 determines whether the calling telephone number is found in step S141 (whether the calling telephone number is stored in the memory unit 136).

If it is determined in step S142 that the telephone number of the calling side is found, the algorithm proceeds to step S143. The management unit 135 selects the quality-enhancement data correspondingly associated with the telephone number of the calling side from among the quality-enhancement data stored in the memory unit 136, and feeds and sets the quality-enhancement data in the decoder 132. The quality-enhancement data setting process ends.

If it is determined in step S142 that no telephone number of the calling side is found, the algorithm proceeds to step S144. The management unit 135 reads default quality-enhancement data (hereinafter referred to as default data) from the default data memory 137, and feeds and sets the default data in the decoder 132. The quality-enhancement data setting process thus ends.

Figure 5:
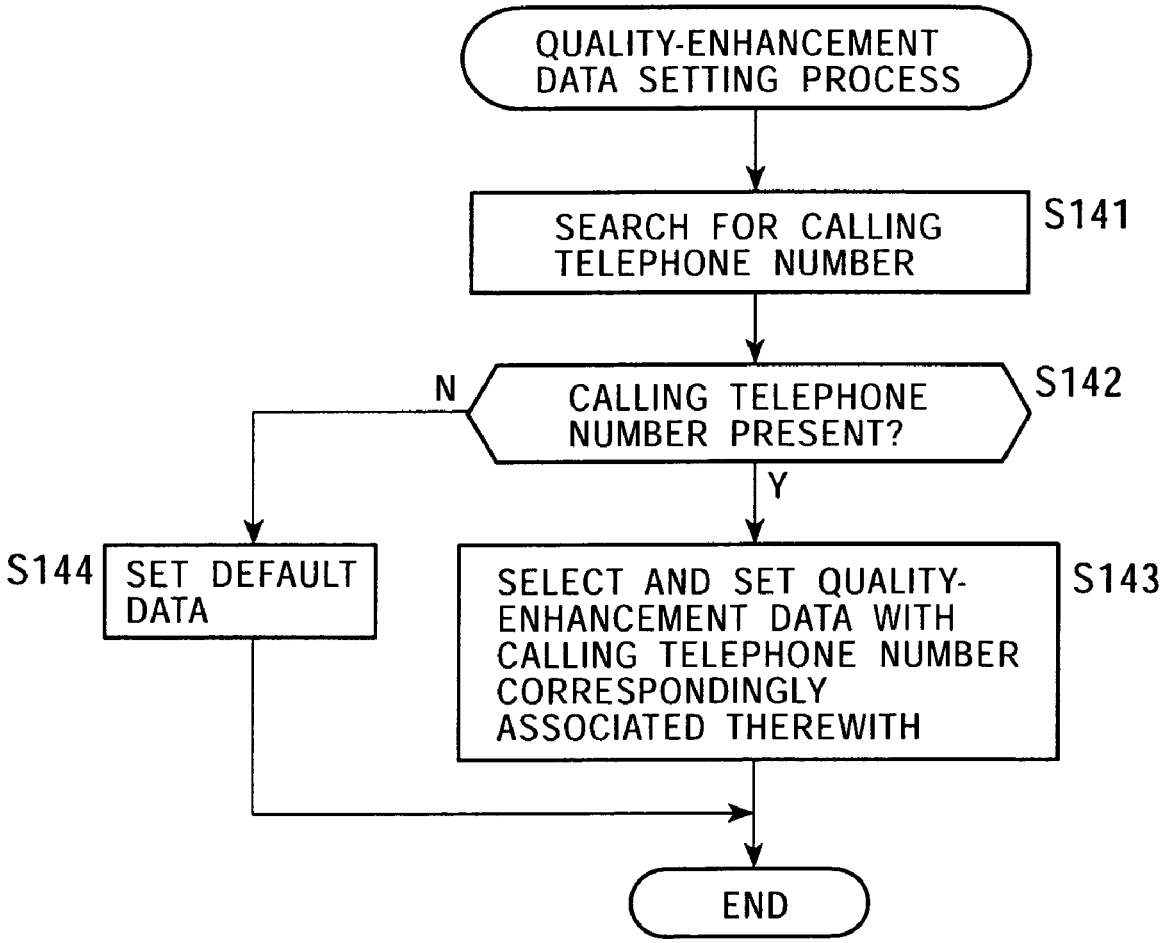
FIG. 5 is a flow diagram illustrating a quality-enhancement data setting process performed by the receiver 114.

In the embodiment illustrated in FIG. 5, the quality-enhancement data correspondingly associated with the telephone number of the calling side is set in the decoder 132 if the telephone number of the calling side is found, in other words, if the telephone number of the calling side is stored in the memory unit 136. By operating the operation unit 115 (FIG. 2), the management unit 135 may be controlled to set the default data in the decoder 132 even if the telephone number of the calling side is found.

The quality-enhancement data is set in the decoder 132 in this way. When the supply of the encoded voice data transmitted from the calling side to the receiver controller 131 starts as the received data, the encoded voice data is fed from the receiver controller 131 to the decoder 132. The decoder 132 decodes the encoded voice data transmitted from the calling side and then supplied from the receiver controller 131, in accordance with the quality-enhancement data set immediately subsequent to the arrival of the call in the quality-enhancement data setting process illustrated in FIG. 5, namely, in accordance with the quality-enhancement data correspondingly associated with the telephone number of the calling side. The decoder 132 thus outputs the decoded voice data. The decoded voice data is fed from the decoder 132 to the loudspeaker 134 through the D/A converter 133.

Upon receiving the quality-enhancement data transmitted from the calling side as the received data, the receiver controller 131 feeds the quality-enhancement data to the management unit 135. The management unit 135 associates the quality-enhancement data supplied from the receiver controller 131 correspondingly with the telephone number of the calling side that has transmitted that quality-enhancement data, and stores the quality-enhancement data in the memory unit 136.

As described above, the quality-enhancement data correspondingly associated with the telephone number of the calling side is obtained when the learning unit 125 in the transmitter 113 (FIG. 3) of the calling side learns the voice of the user of the calling side. The quality-enhancement data is used to decode the encoded voice data, which is obtained by encoding the voice of the user of the calling side, into high-quality decoded voice data.

The decoder 132 in the receiver 114 decodes the encoded voice data transmitted from the calling side in accordance with the quality-enhancement data correspondingly associated with the telephone number of the calling side. The decoding process performed is appropriate for the encoded voice data transmitted from the calling side (the decoding process becomes different depending on the voice characteristics of the user who speaks the voice corresponding to the encoded voice data). High-quality encoded voice data thus results.

To obtain the high-quality decoded voice data using the decoding process appropriate for the encoded voice data transmitted from the calling side, the decoder 132 must perform the decoding process using the quality-enhancement data learned by the learning unit 125 in the transmitter 113 (FIG. 3) on the calling side. To this end, the memory unit 136 must store the quality-enhancement data with the telephone number of the calling side correspondingly associated therewith.

The transmitter 113 (FIG. 3) on the calling side (a transmitting side) performs a quality-enhancement data transmission process to transmit the updated quality-enhancement data obtained through a learning process to a called side (a receiving side) The receiver 114 on the called side performs a quality-enhancement data updating process to update the storage content of the memory unit 136 in accordance with the quality-enhancement data transmitted as a result of the quality-enhancement data transmission process.

The quality-enhancement data transmission process and the quality-enhancement data updating process with the mobile telephone $\mathbf{101}_1$ working as a calling side and the mobile telephone $\mathbf{101}_2$ working as a called side are discussed below.

Figure 6:
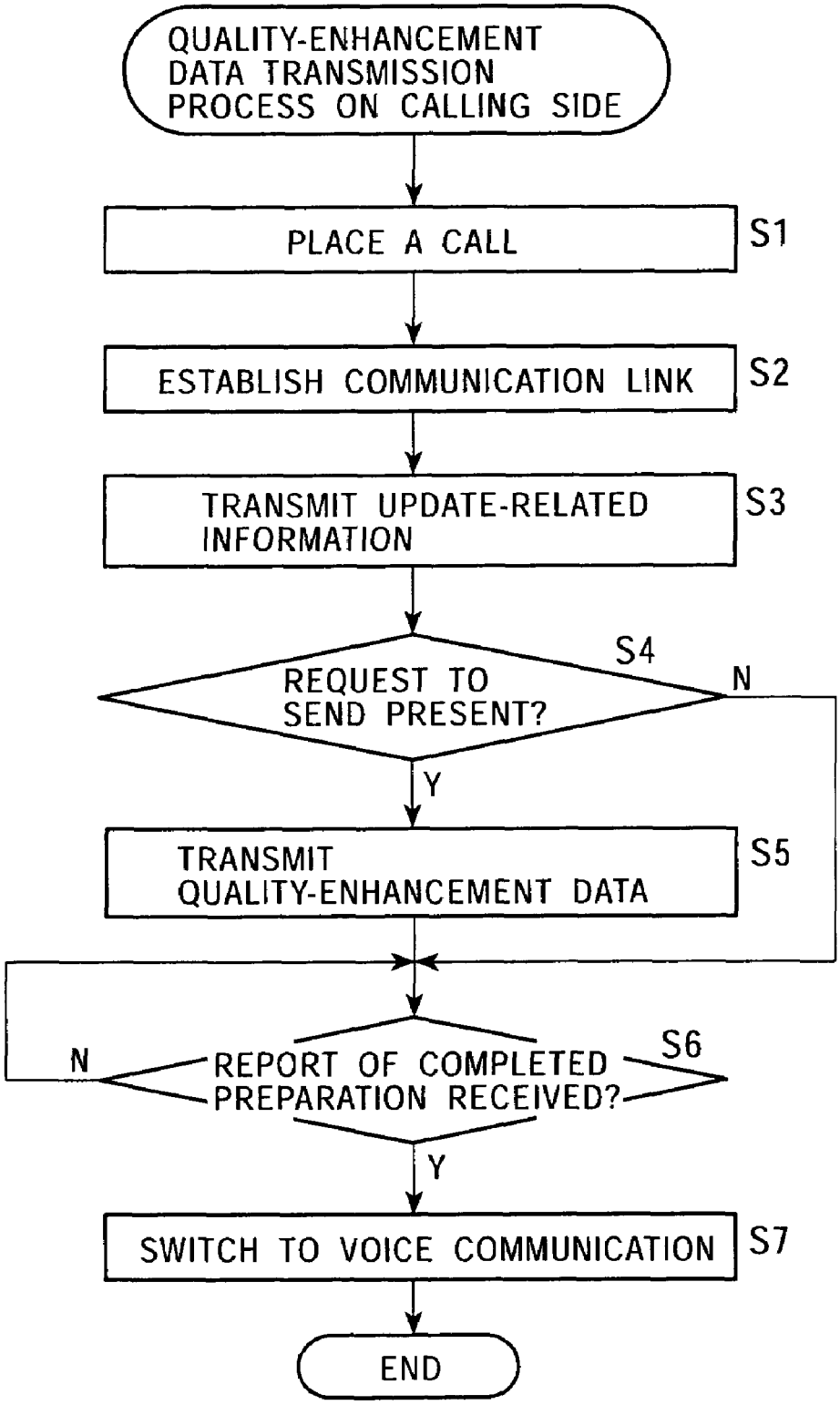
FIG. 6 is a flow diagram illustrating a first embodiment of a quality-enhancement data transmission process performed by a receiving side.

FIG. 6 is a flow diagram illustrating a first embodiment of the quality-enhancement data transmission process.

In the mobile telephone $\mathbf{101}_1$ as the calling side, a user operates the operation unit 115 (FIG. 2), thereby inputting a telephone number of the mobile telephone $\mathbf{101}_2$ working as the called side. The transmitter 113 starts the quality-enhancement data transmission process.

The quality-enhancement data transmission process begins with step S1, in which the transmitter controller 124 in the transmitter 113 (FIG. 3) outputs, as the transmission data, the telephone number of the mobile telephone $\mathbf{101}_2$ input in response to the operation of the operation unit 115. The mobile telephone $\mathbf{101}_2$ is called.

A user of the mobile telephone $\mathbf{101}_2$ operates the operation unit 115 in response to the call from the mobile telephone $\mathbf{101}_1$ to off-hook the mobile telephone $\mathbf{101}_2$. The algorithm proceeds to step S2. The transmitter controller 124 establishes a communication link with the mobile telephone $\mathbf{101}_2$ on the called side. The algorithm proceeds to step S3.

In step S3, the management unit 127 transfers, to the transmitter controller 124, update-related information representing the update state of the quality-enhancement data stored in the memory unit 126, and the transmitter controller 124 selects and outputs the update-related information as transmission data. The algorithm proceeds to step S4.

When the learning unit 125 learns the voice, and obtains updated quality-enhancement data, date and time (including year and month information) at which the quality-enhancement data has been obtained are correspondingly associated with the quality-enhancement data. The quality-enhanced data is then stored in the memory unit 126. Date and time correspondingly associated with the quality-enhancement data are used as the update-related information.

The mobile telephone $\mathbf{101}_2$ on the called side receives the update-related information from the mobile telephone $\mathbf{101}_1$ on the calling side. When the updated quality-enhancement data is required, the mobile telephone $\mathbf{101}_2$ transmits a transmission request of the updated quality-enhancement data as will be discussed later. In step S4, the management unit 127 determines whether the mobile telephone $\mathbf{101}_2$ has transmitted the transmission request.

If it is determined in step S4 that no transmission request has been sent, in other words, if it is determined in step S4 that the receiver controller 131 in the receiver 114 of the mobile telephone $\mathbf{101}_1$ has not received the transmission request from the mobile telephone $\mathbf{101}_2$ on the called side as the received data, the algorithm proceeds to step S6, skipping step S5.

If it is determined in step S4 that the transmission request has been sent, in other words, if it is determined in step S4 that the receiver controller 131 in the receiver 114 of the mobile telephone $\mathbf{101}_1$ has received the transmission request from the mobile telephone $\mathbf{101}_2$ on the called side as the received data, and that the transmission request is fed to the management unit 127 of the transmitter 113, the algorithm proceeds to step S5. The management unit 127 reads the updated quality-enhancement data from the memory unit 126, and feeds it to the transmitter controller 124. In step S5, the transmitter controller 124 selects the updated quality-enhancement data from the management unit 127, and transmits the updated quality-enhancement data as the transmission data. The quality-enhancement data is transmitted together with the update-related information, namely, date and time at which the quality-enhancement data is obtained using a learning process.

The algorithm proceeds from step S5 to step S6. The management unit 127 determines whether the mobile telephone $\mathbf{101}_2$ on the called side has transmitted the report of completed preparation.

When ready to perform a normal voice communication, the mobile telephone $\mathbf{101}_2$ on the called side transmits a report of completed preparation indicating that the mobile telephone $\mathbf{101}_2$ is ready for voice communication. In step S6, the management unit 127 determines whether the mobile telephone $\mathbf{101}_2$ has transmitted such a report of completed preparation.

If it is determined in step S6 that the report of completed preparation has not been transmitted, in other words, if it is determined in step S6 that the receiver controller 131 in the receiver 114 of the mobile telephone $\mathbf{101}_1$ has not received the report of completed preparation from the mobile telephone $\mathbf{101}_2$ on the called side as the received data, step S6 is repeated. The management unit 127 waits until the report of completed preparation is received.

If it is determined in step S6 that the report of completed preparation has been transmitted, in other words, if it is determined in step S6 that the receiver controller 131 in the receiver 114 of the mobile telephone $\mathbf{101}_1$ has received the report of completed preparation from the mobile telephone $\mathbf{101}_2$ on the called side as the received data, and that the report of completed preparation is fed to the management unit 127 in the transmitter 113, the algorithm proceeds to step S7. The transmitter controller 124 selects the output of the encoder 123, thereby enabling voice communication. The encoded voice data output from the encoder 123 is selected as the transmission data. The quality-enhancement data transmission process ends.

Figure 7:
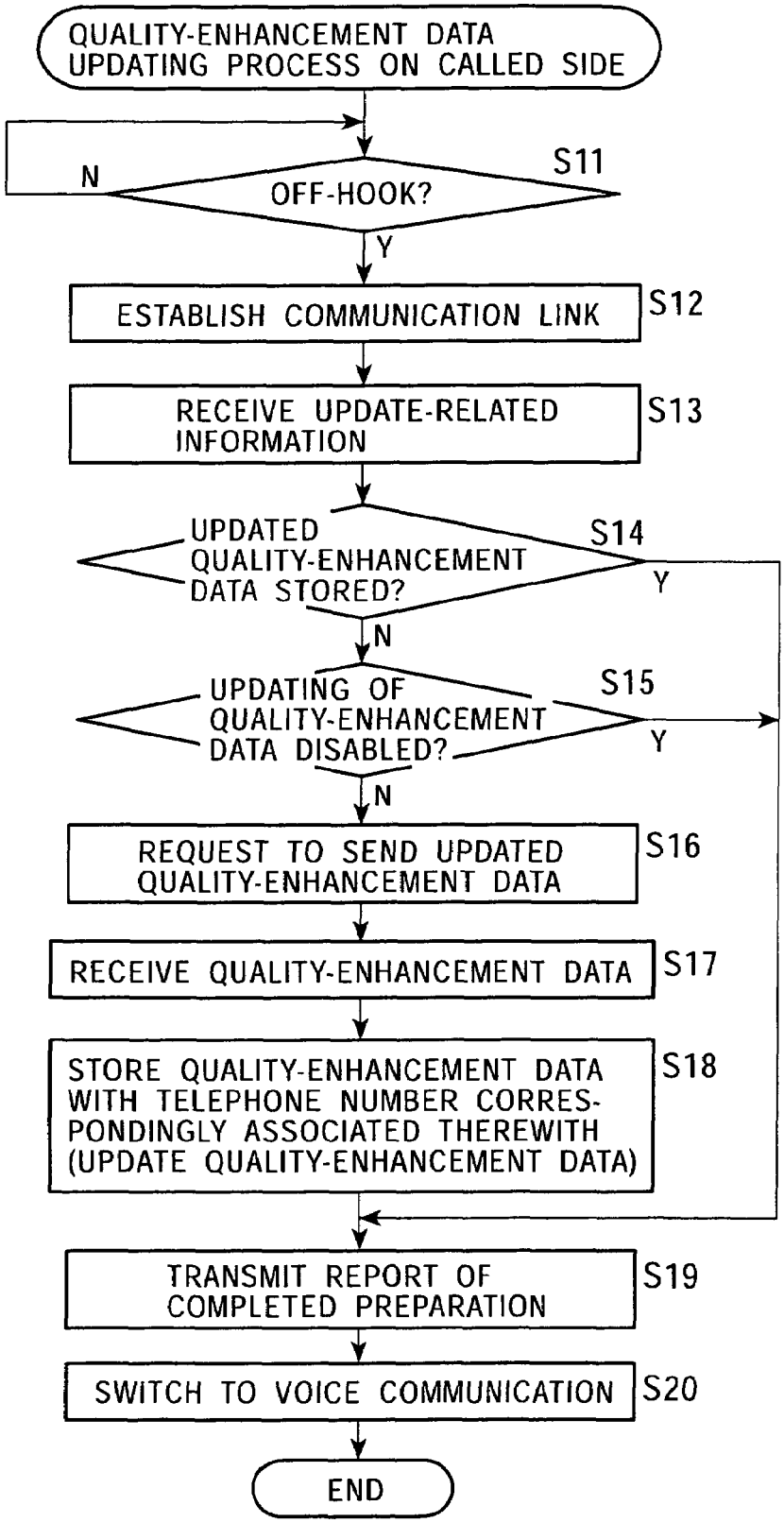
FIG. 7 is a flow diagram illustrating a first embodiment of a quality-enhancement data updating process performed by a transmitting side.

FIG. 7 illustrates the quality-enhancement data updating process which is performed by the mobile telephone $\mathbf{101}_2$ on the called side when the mobile telephone $\mathbf{101}_1$ on the calling side performs the quality-enhancement data transmission process as shown in FIG. 6.

In response to a call, the receiver 114 (FIG. 4) in the mobile telephone $\mathbf{101}_2$ on the called side starts the quality-enhancement data updating process.

The quality-enhancement data updating process begins with step S11, in which the receiver controller 131 determines whether the mobile telephone $\mathbf{101}_2$ is put into an off-hook state in response to the operation of the operation unit 115 by the user. If it is determined that the mobile telephone $\mathbf{101}_2$ is not in the off-hook state, step S11 is repeated.

If it is determined in step S11 that the mobile telephone $\mathbf{101}_2$ is in the off-hook state, the algorithm proceeds to step S12. The receiver controller 131 establishes a communication link with the mobile telephone $\mathbf{101}_1$ on the calling side, and then proceeds to step S13.

The mobile telephone $\mathbf{101}_1$ on the calling side transmits the update-related information as already discussed in connection with step S3 in FIG. 6. In S13, the receiver controller 131 receives data including the update-related information, and transfers the received data to the management unit 135.

In step S14, the management unit 135 references the received update-related information from the mobile telephone $\mathbf{101}_1$ on the calling side, and determines whether the updated quality-enhancement data about the user of the mobile telephone $\mathbf{101}_1$ on the calling side is stored in the memory unit 136.

Specifically, in the communication of the transmission system illustrated in FIG. 1, the telephone number of the mobile telephone $\mathbf{101}_1$ on the calling side is transmitted at the moment a call from the mobile telephone $\mathbf{101}_1$ (or $\mathbf{101}_2$) on the calling side arrives at the mobile telephone $\mathbf{101}_2$ (or $\mathbf{101}_1$) on the called side. The receiver controller 131 receives the telephone number as the received data, and feeds the telephone number to the management unit 135. The management unit 135 determines whether the memory unit 136 stores the quality-enhancement data correspondingly associated with the telephone number of the mobile telephone $\mathbf{101}_1$ on the calling side, and checks to see whether stored quality-enhancement data is updated one if the memory unit 136 stores the quality-enhancement data. The management unit 135 thus performs determination in step S14.

If it is determined in step S14 that the memory unit 136 stores the updated quality-enhancement data about the user of the mobile telephone $\mathbf{101}_1$ on the calling side, in other words, if it is determined in step S14 that the memory unit 136 stores the quality-enhancement data correspondingly associated with the telephone number of the mobile telephone $\mathbf{101}_1$ on the calling side, and that the date and time represented by the update-related information correspondingly associated with the quality-enhancement data coincide with those represented by the update-related information received in step S13, there is no need for updating the quality-enhancement data in the memory unit 136 correspondingly associated with the telephone number of the mobile telephone $101_1$ on the calling side. The algorithm proceeds to step S19, skipping step S15 through step S18.

As already discussed in connection with step S5 in FIG. 6, the mobile telephone $101_1$ on the calling side transmits the quality-enhancement data together with the update-related information. When the quality-enhancement data from the mobile telephone $101_1$ on the calling side is stored in the memory unit 136, the management unit 135 in the mobile telephone $101_1$ on the called side associates the quality-enhancement data correspondingly with the update-related information transmitted together with the quality-enhancement data. In step S14, the update-related information correspondingly associated with the quality-enhancement data stored in the memory unit 136 is compared with the update-related information received in step S13 to determine whether the quality-enhancement data stored in the memory unit 136 is updated one.

If it is determined in step S14 that the memory unit 136 does not store the updated quality-enhancement data about the user of the mobile telephone $101_1$ on the calling side, in other words, if it is determined in step S14 that the memory unit 136 does not store the quality-enhancement data correspondingly associated with the telephone number of the mobile telephone $101_1$ on the calling side, or if it is determined in step S14 that the date and time represented by the update-related information correspondingly associated with the quality-enhancement data are older than the date and time represented by the update-related information received in step S13 even if the memory unit 136 stores the quality-enhancement data, the algorithm proceeds to step S15. The management unit 135 determines whether the updating of the quality-enhancement data is disabled.

The user may set the management unit 135 not to update the quality-enhancement data by operating the operation unit 115. The management unit 135 performs determination in step S15 based on the setting of whether or not to update the quality-enhancement data.

If it is determined in step S15 that the updating of the quality-enhancement data is disabled, in other words, if the management unit 135 is set not to update the quality-enhancement data, the algorithm proceeds to step S19, skipping step S16 through step S18.

If it is determined in step S15 that the updating of the quality-enhancement data is enabled, in other words, if the management unit 135 is set to update the quality-enhancement data, the algorithm proceeds to step S16. The management unit 135 supplies the transmitter controller 124 in the transmitter 113 (FIG. 3) with a transmission request to request the mobile telephone $101_1$ on the calling side to transmit the updated quality-enhancement data. In this way, the transmitter controller 124 in the transmitter 113 transmits the transmission request as transmission data.

As already discussed with reference to steps S4 and S5 illustrated in FIG. 6, the mobile telephone $101_1$ which has received the transmission request transmits the updated quality-enhancement data together with the updated-related information thereof. In step S17, the receiver controller 131 receives the data containing the updated quality-enhancement data and update-related information and supplies the management unit 135 with the received data.

In step S18, the management unit 135 associates the updated quality-enhancement data obtained in step S17 with the telephone number of the mobile telephone $101_1$ on the calling side received at the arrival of the call, and the update-related information transmitted together with the quality-enhancement data, and then stores the quality-enhancement data in the memory unit 136. The content of the memory unit 136 is thus updated.

When the quality-enhancement data correspondingly associated with the telephone number of the mobile telephone $101_1$ on the calling side is not stored in the memory unit 136, the management unit 135 causes the memory unit 136 to store newly the updated quality-enhancement data obtained in step S17, the telephone number of the mobile telephone $101_1$ on the calling side received at the arrival of the call, and the update-related information (the update-related information of the updated quality-enhancement data).

When the quality-enhancement data (not updated one) correspondingly associated with the telephone number of the mobile telephone $101_1$ on the calling side is stored in the memory unit 136, the management unit 135 causes the memory unit 136 to store the updated quality-enhancement data obtained in step S17, the telephone number of the mobile telephone $101_1$ on the calling side received at the arrival of the call, and the update-related information, in other words, these pieces of information replace (overwrite) the quality-enhancement data, and the telephone number and the update-related information correspondingly associated with the quality-enhancement data stored in the memory unit 136.

In step S19, the management unit 135 controls the transmitter controller 124 in the transmitter 113, thereby causing the transmitter controller 124 to transmit a report of completed preparation, as transmission data, indicating that the preparation for voice communication is completed. The algorithm then proceeds to step S20.

In step S20, the receiver controller 131 is put into a voice communication enable state in which the encoded voice data contained in the received data fed thereto is output to the decoder 132. The quality-enhancement data updating process thus ends.

Figure 8:
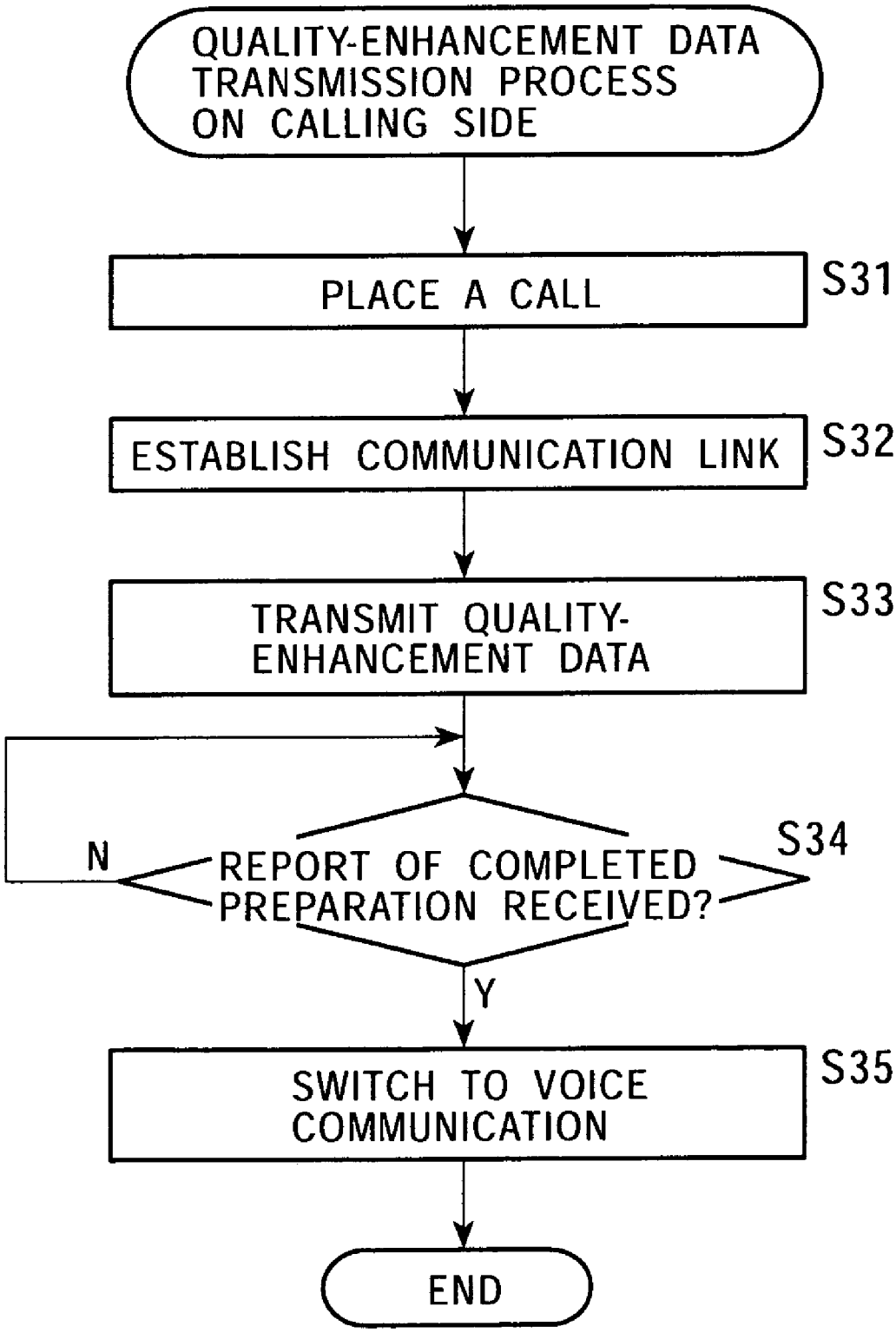
FIG. 8 is a flow diagram illustrating a second embodiment of the quality-enhancement data transmission process performed by a calling side.

FIG. 8 is a flow diagram illustrating a second embodiment of the quality-enhancement data transmission process.

As in the same manner shown in the flow diagram in FIG. 6, a user operates the operation unit 115 (FIG. 2) in the mobile telephone $101_1$ on the calling side to input the telephone number of the mobile telephone $101_2$ on the called side. The transmitter 113 starts the quality-enhancement data transmission process.

The quality-enhancement data transmission process begins with step S31. The transmitter controller 124 in the transmitter 113 (FIG. 3) outputs, as the transmission data, the telephone number of the mobile telephone $101_2$ which is input using the operation unit 115. The mobile telephone $101_2$ is thus called.

The user of the mobile telephone $101_2$ operates the operation unit 115 in response to the call from the mobile telephone $101_1$, thereby putting the mobile telephone $101_2$ into an off-hook state. The algorithm proceeds to step S32. The transmitter controller 124 establishes a communication link with the mobile telephone $101_2$ on the called side, and then proceeds to step S33.

In step S33, the management unit 127 reads the updated quality-enhancement data from the memory unit 126, and supplies the transmitter controller 124 with the updated quality-enhancement data. Also in step S33, the transmitter controller 124 selects the updated quality-enhancement data from the management unit 127, and transmits the selected quality-enhancement data as the transmission data. As already discussed, the quality-enhancement data is transmitted together with the update-related information indicating the date and time at which that quality-enhancement data is obtained using a learning process.

The algorithm proceeds from step S33 to step S34. As in step S6 illustrated in FIG. 6, the management unit 127 determines whether the report of completed preparation has been transmitted from the mobile telephone $\mathbf{101}_2$ on the called side. If it is determined that no report of completed preparation has been transmitted, step S34 is repeated. The management unit 127 waits until the report of completed preparation is transmitted.

If it is determined in step S34 that the report of completed preparation has been transmitted, the algorithm proceeds to step S35. As in step S7 illustrated in FIG. 6, the transmitter controller 124 becomes ready for voice communication. The quality-enhancement data transmission process ends.

The quality-enhancement data updating process performed by the mobile telephone $\mathbf{101}_2$ on the called side when the mobile telephone $\mathbf{101}_1$ on the calling side shown in FIG. 8 carries out the quality-enhancement data transmission process is discussed with reference to a flow diagram illustrated in FIG. 9.

In the same way as shown in FIG. 7, the receiver 114 (FIG. 4) of the mobile telephone $\mathbf{101}_2$ on the called side starts the quality-enhancement data updating process in response to a call. In step S41, the receiver controller 131 determines whether the user puts the mobile telephone $\mathbf{101}_2$ into an off-hook state by operating the operation unit 115. If it is determined that the mobile telephone $\mathbf{101}_2$ is not in the off-hook state, step S41 is repeated.

If it is determined in step S41 that the mobile telephone $\mathbf{101}_2$ is in the off-hook state, the algorithm proceeds to step S42. In the same way as in step S12 illustrated in FIG. 7, a communication link is established, and the algorithm proceeds to step S43. In step S43, the receiver controller 131 receives data containing the updated quality-enhancement data transmitted from the mobile telephone $\mathbf{101}_1$ on the calling side, and supplies the management unit 135 with the received data.

As already described with reference to the quality-enhancement data transmission process illustrated in FIG. 8, the mobile telephone $\mathbf{101}_1$ transmits the updated quality-enhancement data together with the update-related information in step S33, and the mobile telephone $\mathbf{101}_2$ thus receives the quality-enhancement data and the update-related information in step S43.

The algorithm proceeds to step S44. In the same way as in step S14 illustrated in FIG. 7, the management unit 135 references the update-related information received from the mobile telephone $\mathbf{101}_1$ on the calling side, thereby determining whether the memory unit 136 stores the updated quality-enhancement data about the user of the mobile telephone $\mathbf{101}_1$ on the calling side.

If it is determined in step S44 that the memory unit 136 stores the updated quality-enhancement data about the user of the mobile telephone $\mathbf{101}_1$ on the calling side, the algorithm proceeds to step S45. The management unit 135 discards the quality-enhancement data and the update-related information received in step S43, and then proceeds to step S47.

If it is determined in step S44 that the updated quality-enhancement data about the user of the mobile telephone $\mathbf{101}_1$ on the calling side is not stored in the memory unit 136, the algorithm proceeds to step S46. In the same way as in step S18 illustrated in FIG. 7, the management unit 135 associates the updated quality-enhancement data obtained in step S43 with the telephone number of the mobile telephone $\mathbf{101}_1$ on the calling side received at the arrival of the call, and the update-related information transmitted together with the quality-enhancement data, and then stores the quality-enhancement data in the memory unit 136. The content of the memory unit 136 is thus updated.

In step S47, the management unit 135 controls the transmitter controller 124 in the transmitter 113, thereby causing the transmitter controller 124 to transmit, as the transmission data, the report of completed preparation indicating that the mobile telephone $\mathbf{101}_2$ is ready for voice communication. The algorithm then proceeds to step S48.

In step S48, the receiver controller 131 is put into a voice communication enable state, in which the receiver controller 131 outputs the encoded voice data contained in the received data fed thereto to the decoder 132. The quality-enhancement data updating process ends.

Figure 9:
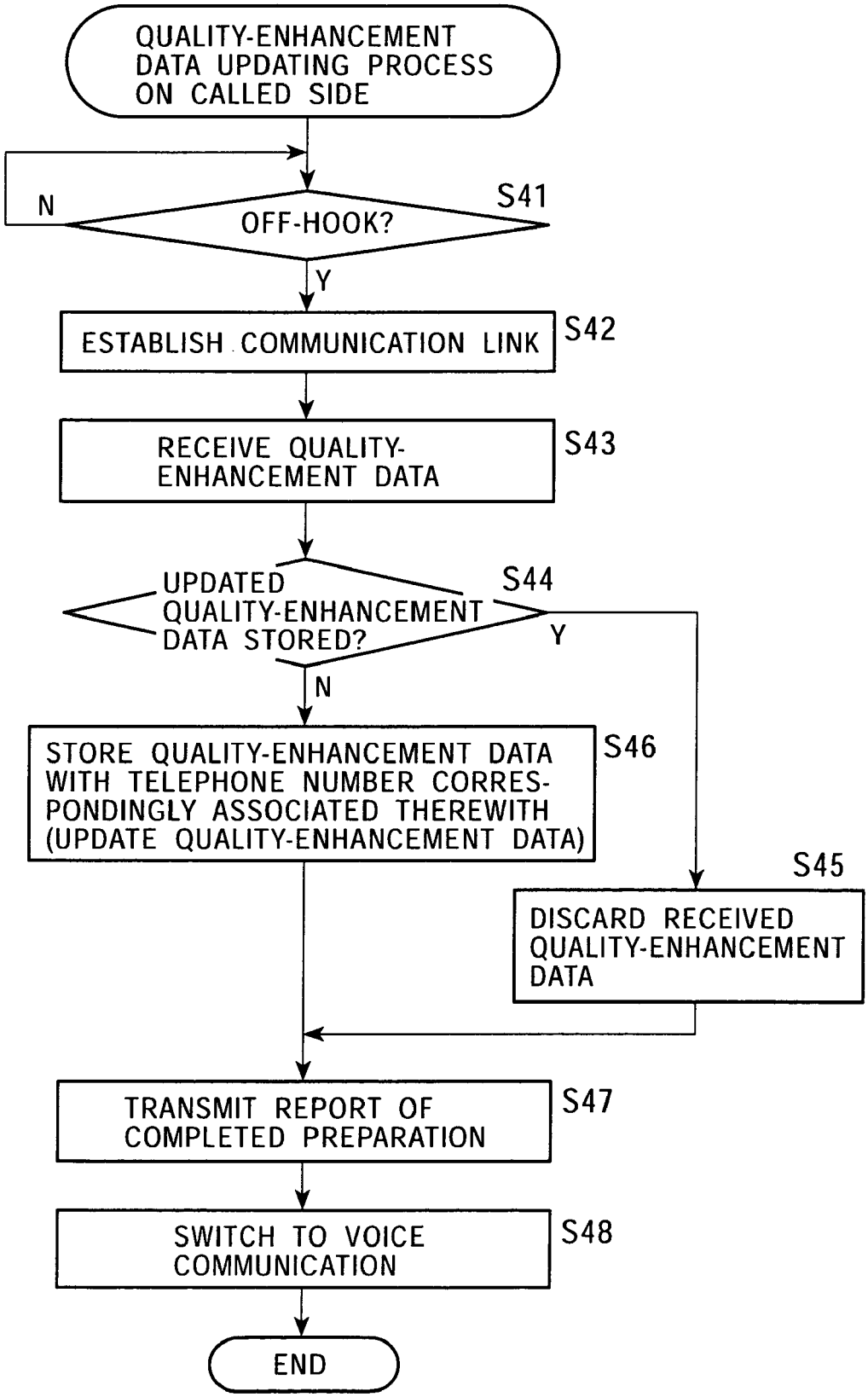
FIG. 9 is a flow diagram illustrating a second embodiment of the quality-enhancement data updating process performed by a called side.

In the quality-enhancement data updating process illustrated in FIG. 9, the content of the memory unit 136 is necessarily updated unless the updated quality-enhancement data about the user of the mobile telephone $\mathbf{101}_1$ on the calling side is stored in the mobile telephone $\mathbf{101}_2$ on the called side.

Figure 10:
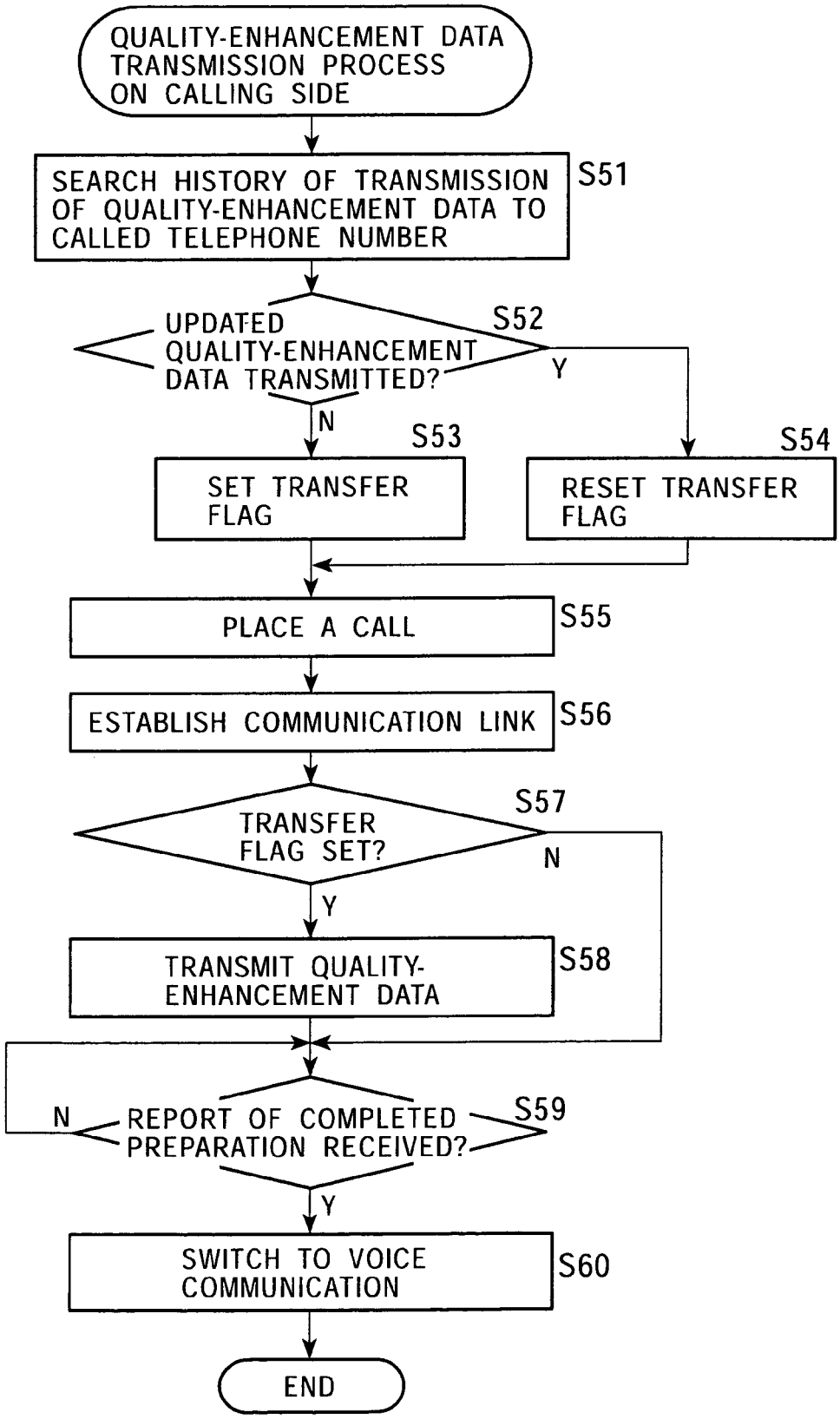
FIG. 10 is a flow diagram illustrating a third embodiment of the quality-enhancement data transmission process performed by the calling side.

FIG. 10 is a flow diagram in accordance with a third embodiment of the quality-enhancement data transmission process.

When the user operates the operation unit 115 (FIG. 2) in the mobile telephone $\mathbf{101}_1$ on the calling side to input the telephone number of the mobile telephone $\mathbf{101}_2$ on the called side, the transmitter 113 (FIG. 3) starts the quality-enhancement data transmission process. In step S51, the management unit 127 searches for the history of transmission of the quality-enhancement data to the mobile telephone $\mathbf{101}_2$ corresponding to the telephone number which is input when the operation unit 115 is operated.

When the quality-enhancement data is transmitted to the called side in step S58 to be discussed later, the management unit 127 stores in an internal memory (not shown), as the transmission history of the quality-enhancement data, information that correspondingly associates the update-related information of the transmitted quality-enhancement data with the telephone number of the called side in the embodiment illustrated in FIG. 10. In step S52, the management unit 127 searches for the transmission history having the telephone number of the called side input in response to the operation of the operation unit 115.

In step S52, the management unit 127 determines whether the updated quality-enhancement data has been transmitted to the called side based on the search result in step S51.

If it is determined in step S52 that the updated quality-enhancement data has not been transmitted to the called side, in other words, if it is determined in step S52 that there is no description of the telephone number of the called side, or if it is determined in step S52 that the update-related information described in the transmission history fails to coincide with the update-related information of the updated quality-enhancement data even if there is a description of the telephone number, the algorithm proceeds to step S53. The management unit 127 sets a transfer flag to indicate whether or not to transmit the updated quality-enhancement data, and then proceeds to step S55.

The transfer flag is a one-bit flag, and is 1 when set, or 0 when reset.

If it is determined in step S52 that the updated quality-enhancement data has been transmitted to the called side, in other words, if it is determined in step S52 that the transmission history contains the description of the telephone number of the called side, and that the update-related information described in the transmission history coincides with the latest update-related information, the algorithm proceeds to step S54. The management unit 127 resets the transfer flag, and then proceeds to step S55.

In step S55, the transmitter controller 124 outputs, as the transmission data, the telephone number of the mobile telephone $\mathbf{101}_2$ on the called side input in response to the operation of the operation unit 115, thereby calling the mobile telephone $\mathbf{101}_2$.

When the user of the mobile telephone $\mathbf{101}_2$ puts the mobile telephone $\mathbf{101}_2$ into the off-hook state by operating the operation unit 115 in response to the call from the mobile telephone $\mathbf{101}_1$, the algorithm proceeds to step S56. The transmitter controller 124 establishes a communication link with the mobile telephone $\mathbf{101}_2$ on the called side, and the algorithm proceeds to step S57.

In step S57, the management unit 127 determines whether or not the transfer flag is set. If it is determined that the transfer flag is not set, in other words, that the transfer flag is reset, the algorithm proceeds to step S59, skipping step S58.

If it is determined in step S57 that the transfer flag is set, the algorithm proceeds to step S58. The management unit 127 reads the updated quality-enhancement data and the update-related information from the memory unit 126, and supplies the transmitter controller 124 with the updated quality-enhancement data and the update-related information. In step S58, the transmitter controller 124 selects and transmits the updated quality-enhancement data and the update-related information from the management unit 127 as the transmission data. Further in step S58, the management unit 127 stores information, which associates the telephone number of the mobile telephone $\mathbf{101}_2$ which has transmitted the updated quality-enhancement data (the telephone number of the called side) correspondingly with the update-related information, as transmission history. The algorithm then proceeds to step S59.

If the telephone number of the mobile telephone $\mathbf{101}_2$ is already stored in the transmission history, the management unit 127 stores the telephone number of the mobile telephone $\mathbf{101}_2$ which has transmitted the updated quality-enhancement data and the update-related information of the updated quality-enhancement data, thereby overwriting the already stored telephone number and transmission history.

In the same way as in step S6 illustrated in FIG. 6, the management unit 127 determines in step S59 whether the mobile telephone $\mathbf{101}_2$ on the called side has transmitted the report of completed preparation. If it is determined that no report of completed preparation has been transmitted, step S59 is repeated. The management unit 127 waits until the report of completed preparation is transmitted.

If it is determined in step S59 that the report of completed preparation has been transmitted, the algorithm proceeds to step S60. The transmitter controller 124 is put into a voice communication enable state, ending the quality-enhancement data transmission process.

Figure 11:
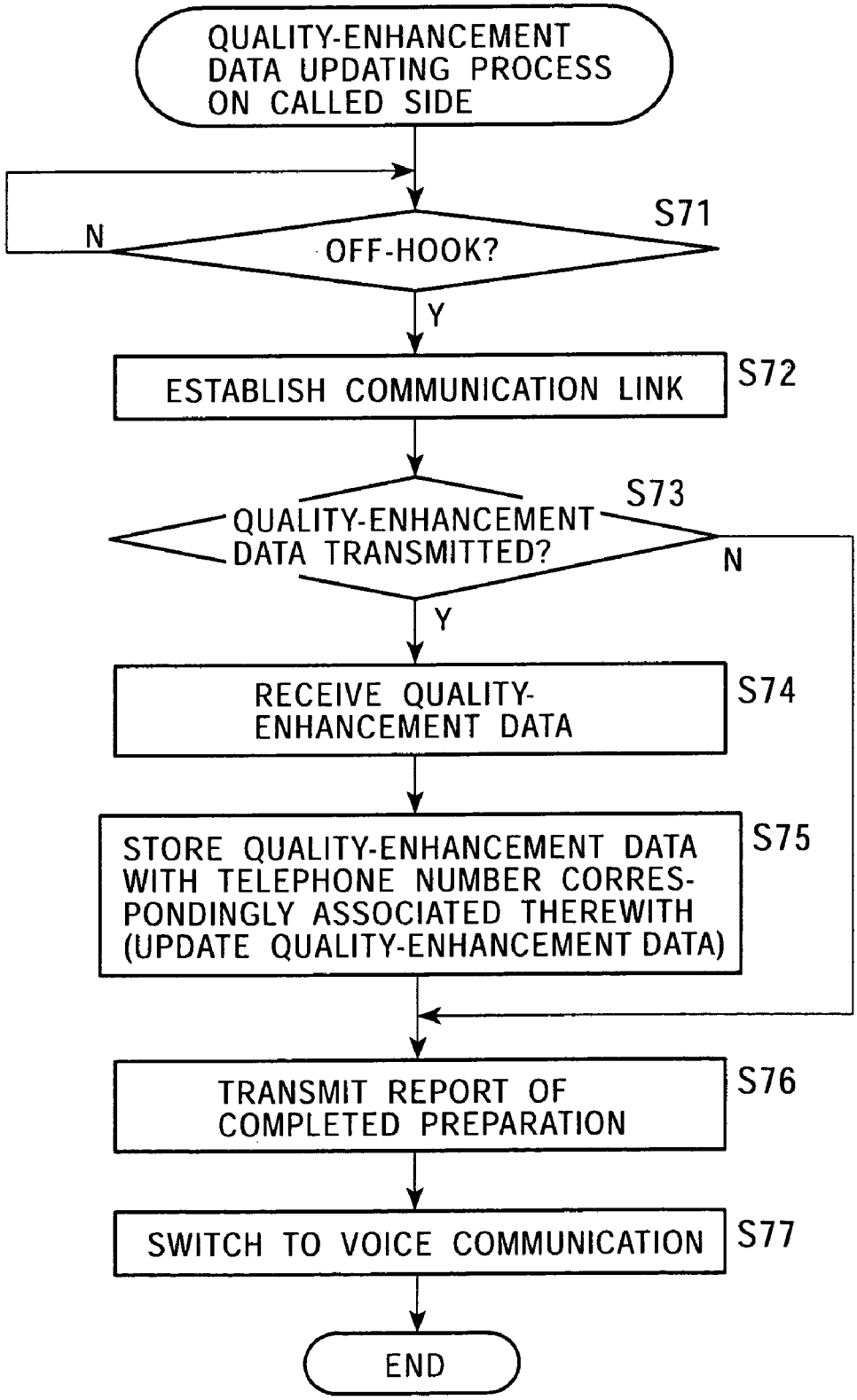
FIG. 11 is a flow diagram illustrating a third embodiment of the quality-enhancement data updating process performed by the called side.

The quality-enhancement data updating process of the mobile telephone $\mathbf{101}_2$ performed when the quality-enhancement data transmission process of the mobile telephone $\mathbf{101}_1$ on the calling side shown in FIG. 10 is performed is discussed with reference to a flow diagram illustrated in FIG. 11.

The receiver 114 (FIG. 4) starts the quality-enhancement data updating process in the mobile telephone $\mathbf{101}_2$ on the called side in response to the arrival of a call.

The quality-enhancement data updating process begins with step S71. The receiver controller 131 determines whether the user operates the operation unit 115 for the off-hook state. If it is determined that the operation unit 115 is not in the off-hook state, step S71 is repeated.

If it is determined in step S71 that the operation unit 115 is in the off-hook state, the algorithm proceeds to step S72. The receiver controller 131 establishes a communication link with the mobile telephone $\mathbf{101}_1$, and then proceeds to step S73.

In step S73, the receiver controller 131 determines whether the quality-enhancement data has been transmitted. If it is determined that the quality-enhancement data has not been transmitted, the algorithm proceeds to step S76, skipping step S74 and step S75.

If it is determined in step S73 that the quality-enhancement data has been transmitted, in other words, if it is determined that the mobile telephone $\mathbf{101}_1$ on the calling side has transmitted the updated quality-enhancement data and the update-related information in step S58 shown in FIG. 10, the algorithm proceeds to step S74. The receiver controller 131 receives data containing the updated quality-enhancement data and the update-related information, and supplies the management unit 135 with the received data.

In the same way as in step S18 illustrated in FIG. 7, the management unit 135 associates the updated quality-enhancement data received in step S74 correspondingly with the telephone number of the mobile telephone $\mathbf{101}_1$ on the calling side received at the arrival of the call, and the updated-related information transmitted together with the quality-enhancement data before storing the updated quality-enhancement data in the memory unit 136. The content of the memory unit 136 is thus updated.

In step S76, the management unit 135 controls the transmitter controller 124 in the transmitter 113, thereby transmitting, as transmission data, the report of completed preparation indicating the mobile telephone $\mathbf{101}_2$ on the called side is ready for voice communication. The algorithm then proceeds to step S77.

In step S77, the receiver controller 131 is voice communication enabled, thereby ending the quality-enhancement data updating process.

Each of the quality-enhancement data transmission process and the quality-enhancement data updating process discussed with reference to FIG. 6 through FIG. 11 is performed at a calling timing or called timing. Each of the quality-enhancement data transmission process and the quality-enhancement data updating process may be performed at any other timing.

Figure 12:
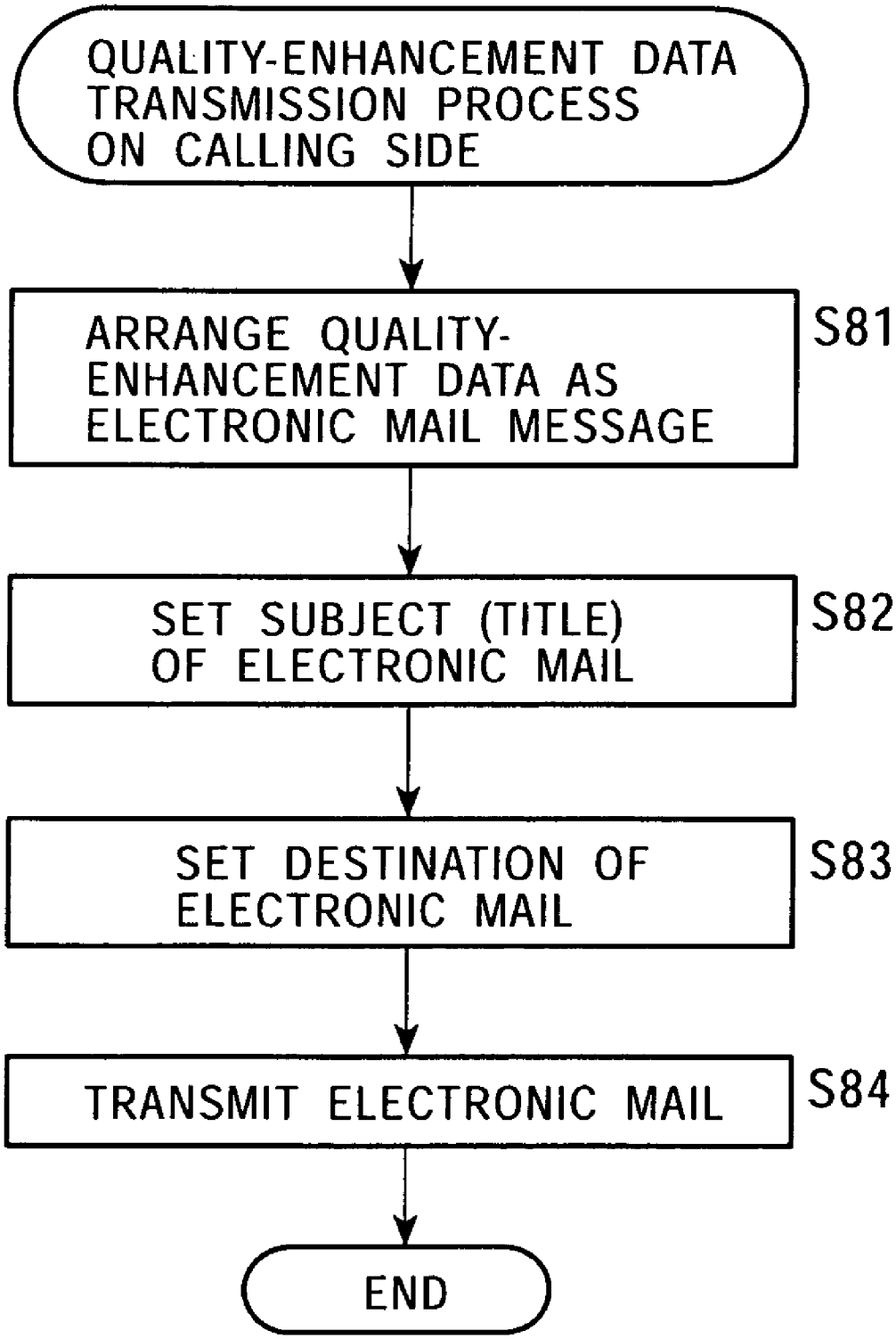
FIG. 12 is a flow diagram illustrating a fourth embodiment of the quality-enhancement updating process performed by the calling side.

FIG. 12 is a flow diagram which shows a quality-enhancement data transmission process which is performed by the transmitter 113 (FIG. 3) after the updated quality-enhancement data is obtained using a learning process in the mobile telephone $\mathbf{101}_1$ on the calling side.

In step S81, the management unit 127 arranges, as an electronic mail message, the updated quality-enhancement data, the update-related information thereof, and the telephone number of its own stored in the memory unit 126, and then proceeds to step S82.

In step S82, the management unit 127 arranges a notice, indicating that an electronic mail contains the updated quality-enhancement data, as a subject (a title) of the electronic mail (hereinafter referred to as an electronic mail for quality-enhancement data transmission) including the updated quality-enhancement data, the update-related information, and the telephone number of the calling side. Specifically, the management unit 127 arranges a "update notice" as the subject of an electronic mail for quality-enhancement data transmission.

In step S83, the management unit 127 sets a mail address serving as a destination of the electronic mail for quality-enhancement data transmission. The mail address serving as the destination of the electronic mail for quality-enhancement data transmission may be one of mail addresses with which electronic mails are exchanged in the past. For example, mail addresses with which electronic mails are exchanged are stored, and all these mail addresses or some of these mail addresses specified by the user may be arranged.

In step S84, the management unit 127 supplies the transmitter controller 124 with the quality-enhancement data transmission electronic mail, thereby transmitting the main as transmission data. The quality-enhancement data transmission process ends.

The quality-enhancement data transmission electronic mail thus transmitted is received by a terminal having the mail address arranged as the destination of the quality-enhancement data transmission electronic mail via a predetermined server.

Figure 13:
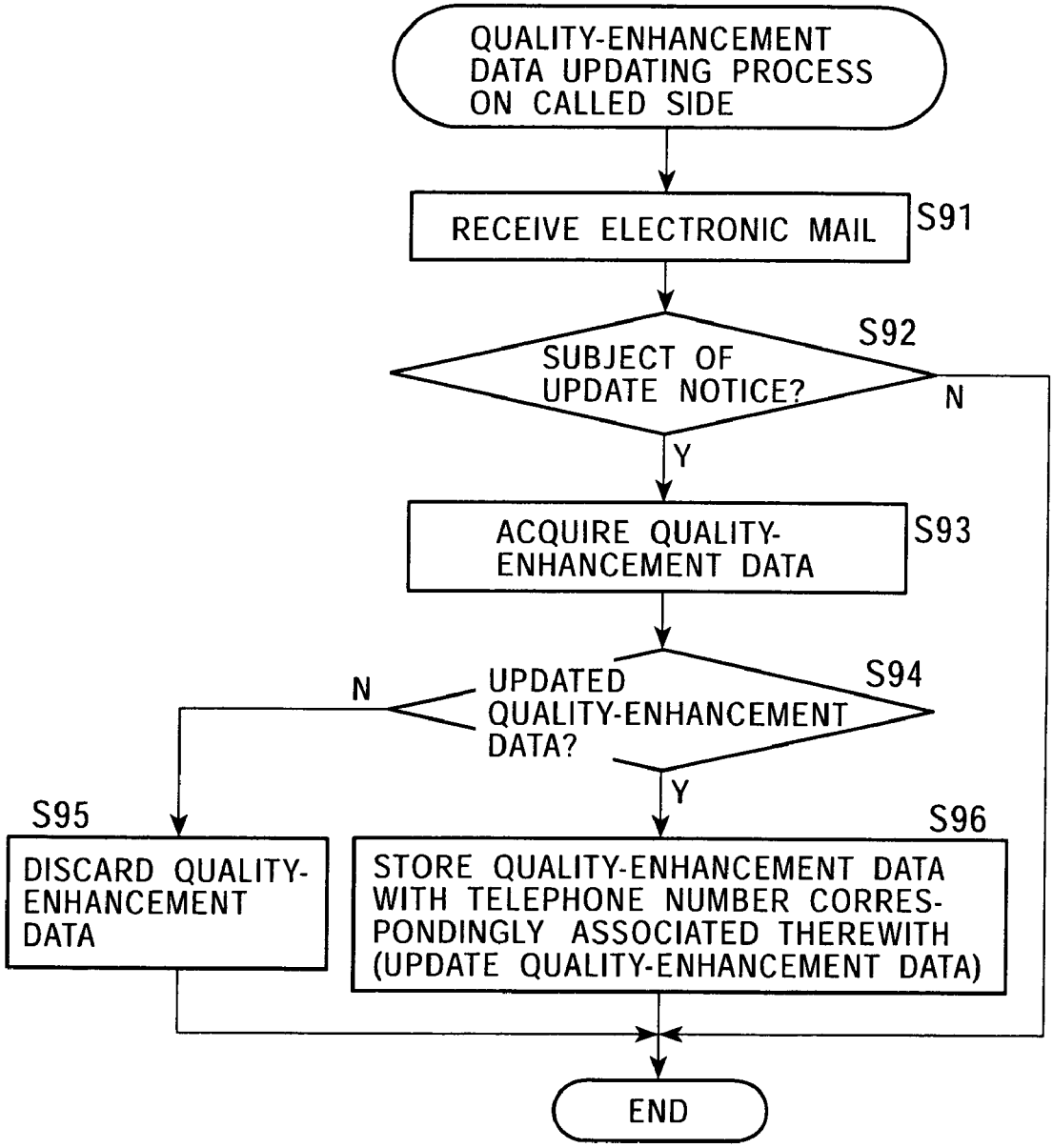
FIG. 13 is a flow diagram of a fourth embodiment of the quality-enhancement data updating process performed by the called side.

FIG. 13 is a flow diagram of a quality-enhancement data updating process which is performed by the mobile telephone $\mathbf{101}_2$ on the called side when the quality-enhancement data transmission process illustrated in FIG. 12 is performed by the mobile telephone $\mathbf{101}_1$ on the calling side.

In the mobile telephone $\mathbf{101}_2$ on the called side, a request to send electronic mail is placed on a predetermined mail server at a predetermined timing or in response to a command of the user. In response to the request, the receiver 114 (FIG. 4) starts the quality-enhancement data updating process.

In step S91, the electronic mail which is transmitted from the mail server in response to the request to send electronic mail is received by the receiver controller 131. The received data is then fed to the management unit 135.

In step S92, the management unit 135 determines whether the subject of the electronic mail supplied from the receiver controller 131 includes the "update notice" indicating that the subject contains the updated quality-enhancement data. If it is determined that the subject is not the "update notice", in other words, if it is determined that the electronic mail is not the quality-enhancement data transmission electronic mail, the quality-enhancement data transmission process ends.

If it is determined in step S92 that the subject of the electronic mail is the "update notice", in other words, if it is determined that the electronic mail is the quality-enhancement data transmission electronic mail, the algorithm proceeds to step S93. The management unit 135 acquires the updated quality-enhancement data, the update-related information, and the telephone number of the calling side arranged as the message of the quality-enhancement data transmission electronic mail, and then proceeds to step S94.

In the same way as in step S14 illustrated in FIG. 7, the management unit 135 references the update-related information and the telephone number on the calling side acquired from the quality-enhancement data transmission electronic mail, and determines whether the updated quality-enhancement data about the user of the mobile telephone $\mathbf{101}_1$ on the calling side is stored in the memory unit 136.

If it is determined in step S94 that the updated quality-enhancement data about the user of the mobile telephone $\mathbf{101}_1$ on the calling side is stored in the memory unit 136, the algorithm proceeds to step S95. The management unit 135 discards the quality-enhancement data, the updated-related information, and the telephone number acquired in step S93, thereby ending the quality-enhancement data updating process.

If it is determined in step S94 that the updated quality-enhancement data about the user of the mobile telephone $\mathbf{101}_1$ on the calling side is not stored in the memory unit 136, the algorithm proceeds to step S96. In the same way as in step S18 illustrated in FIG. 7, the memory unit 136 stores the quality-enhancement data, and the update-related information acquired in step S93, and the telephone number of the mobile telephone $\mathbf{101}_1$ on the calling side. The content of the memory unit 136 is thus updated, and the quality-enhancement data updating process is finished.

Figure 14:
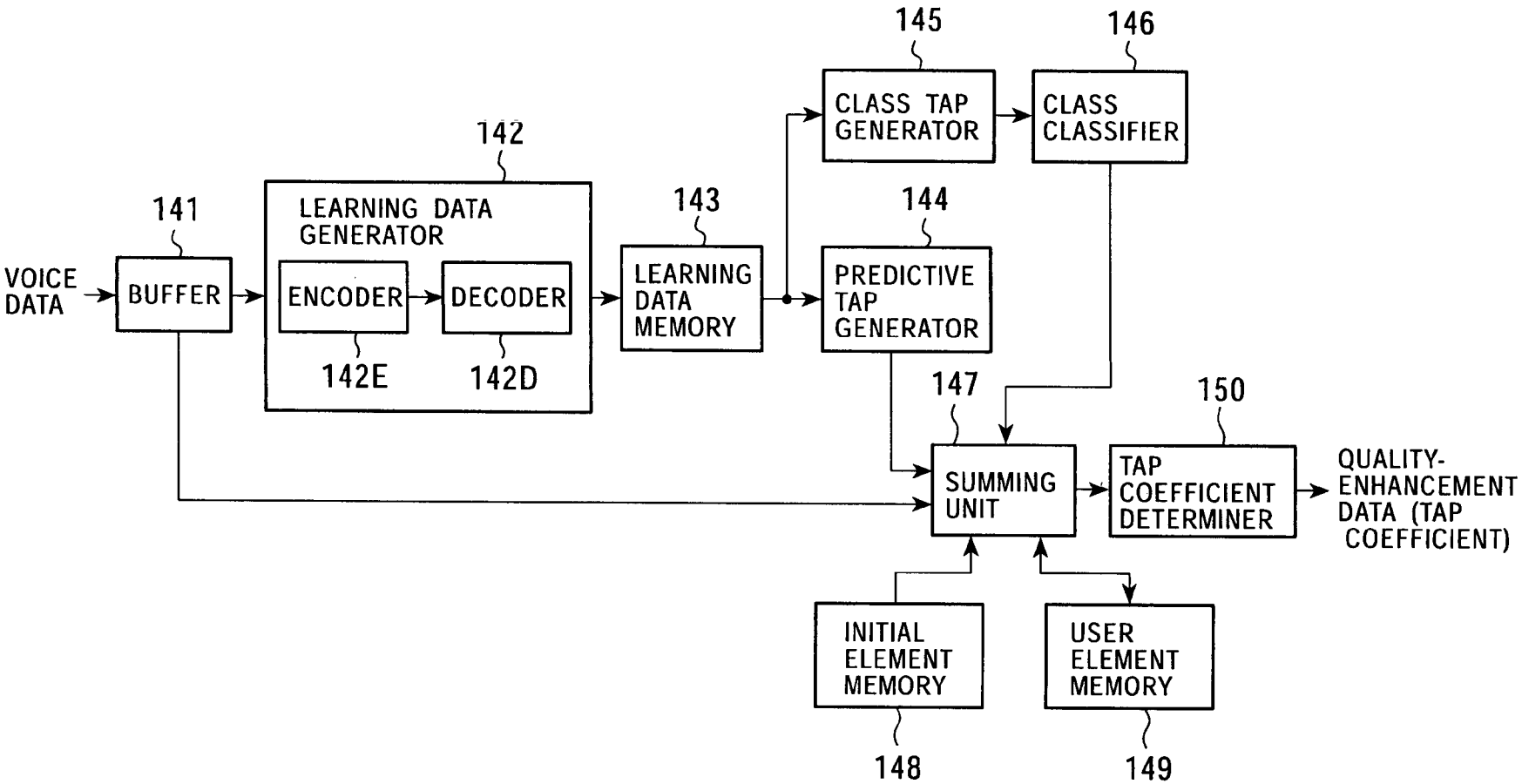
FIG. 14 is a block diagram illustrating the construction of a learning unit 125.

FIG. 14 illustrates the construction of the learning unit 125 in the transmitter 113 illustrated in FIG. 3.

In the embodiment illustrated in FIG. 14, the learning unit 125 learns, as encoded voice data, a tap coefficient for use in a class classifying and adaptive technique already proposed by the inventors of this invention.

The class classifying and adaptive technique includes a class classifying process and an adaptive process. Using the class classifying and adaptation technique, data is classified according to property thereof, and the adaptive process is carried out for each class.

The adaptive process is discussed in which a voice having a low pitch (hereinafter also referred to as a low-pitched voice) is converted into a voice having a high pitch (hereinafter also referred to as a high-pitched voice).

The adaptive process linearly synthesizes a voice sample forming the low-pitched voice (hereinafter also referred to as a low-pitched voice sample) and a predetermined tap coefficient, and thus determines predictive value of a voice sample of the high-pitched voice, which has an improved quality advantage over the low-pitched voice. The low-pitched voice is thus improved with the tone thereof heightened.

Specifically, one piece of high-pitched voice data is training data of in a learning process, and another piece of low-pitched voice data having a degraded voice quality is learning data in the learning process. A predictive value E[y] of a voice sample of high-pitched voice (hereinafter also referred to as a high-pitched voice sample) y is determined from a linear first order synthesis model that is defined by a linear synthesis of a set of several low-pitched voice samples (forming the low-pitched voice) $x_1, x_2, \ldots$ and predetermined tap coefficients $w_1, w_2, \ldots$. The predictive value E[y] is expressed by the following equation.

$$E[y]=w_1x_1+w_2x_2+\ldots \tag{1}$$

Now, equation (1) is generalized. Matrix W composed of a set of a tap coefficient $w_j$, matrix X composed of a set of learning data $x_{ij}$, and matrix Y' composed of a set of predictive value $E[y_i]$ are expressed as below.

[Equation 1]

$$X=\begin{bmatrix} x_{11} & x_{12} & \cdots & x_{1J} \\ x_{21} & x_{22} & \cdots & x_{2J} \\ \cdots & \cdots & \cdots & \cdots \\ x_{I1} & x_{I2} & \cdots & x_{IJ} \end{bmatrix}$$

$$W=\begin{pmatrix} w_1 \\ w_2 \\ \cdots \\ w_J \end{pmatrix},\ Y'=\begin{pmatrix} E[y_1] \\ E[y_2] \\ \cdots \\ E[y_J] \end{pmatrix}$$

The following observation equation holds.

$$XW=Y' \quad (2)$$

where an element $x_{ij}$ of the matrix x represents j-th column learning data among a set of learning data at an i-th row (a set of learning data used to predict training data at an i-th row $y_i$), and element $w_j$ of the matrix w represents a tap coefficient which is multiplied by learning data at j-th column from among the set of learning data. Furthermore, $y_i$ represents training data at i-th row, and $E[y_i]$ represents a predictive value of the training data at i-th row. In equation (1), y on the left side represents an element $y_i$ of matrix Y with subscript i omitted, and $x_1, x_2, \ldots$ on the left hand side represent $x_{ij}$ of the matrix X with subscript i omitted.

Least square method is applied to the observation equation (2) to determine a predictive value E[y] close to the high-pitched voice sample y. Now, matrix Y including a set of true value y of the high-pitched voice sample which is the training data, and matrix E including a set of remainders e of the predictive value E[y] of the high-pitched voice sample y (an error to the true value) are defined as follows:

[Equation 2]

$$E=\begin{pmatrix} e_1 \\ e_2 \\ \cdots \\ e_I \end{pmatrix}, Y=\begin{pmatrix} y_1 \\ y_2 \\ \cdots \\ y_I \end{pmatrix}$$

From equation (2), the following remainder equation holds.

$$XW=Y+E \quad (3)$$

The tap coefficient $w_j$ to determine the predictive value E[y] close to the high-pitched voice sample y is determined by minimizing the following squared error.

[Equation 3]

$$\sum_{i=1}^{I} e_i^2$$

If the above squared error differentiated with respect to the tap coefficient $w_j$ becomes zero, the tap coefficient $w_j$ is an optimum value. Specifically, the tap coefficient $w_j$ satisfying the following equation is the optimum value for determining the predictive value E[y] close to the high-pitched voice sample y.

[Equation 4] (4)

$$e_1\frac{\partial e_1}{\partial w_j}+e_2\frac{\partial e_2}{\partial w_j}+\ldots+e_1\frac{\partial e_I}{\partial w_j}=0 \ (j=1, 2, \ldots, J)$$

The following equation is obtained by differentiating equation (3) with respect to the tap coefficient $w_j$.

[Equation 5] (5)

$$\frac{\partial e_i}{\partial w_1}=x_{i1}, \frac{\partial e_i}{\partial w_2}=x_{i2}, \ldots, \frac{\partial e_i}{\partial w_J}=x_{iJ}, (i=1, 2, \ldots, I)$$

Equation (6) is derived from equations (4) and (5).

[Equation 6] (6)

$$\sum_{i=1}^{I} e_i x_{i1}=0, \sum_{i=1}^{I} e_i x_{i2}=0, \ldots \sum_{i=1}^{I} e_i x_{iJ}=0$$

The following normal equation is derived from equation (6) taking into consideration the relationship of the learning data $x_{ij}$, tap coefficient $w_j$, training data $y_i$, and remainder e in the remainder equation (3).

[Equation 7] (7)

$$\begin{cases} \left(\sum_{i=1}^{I} x_{iJ}x_{i1}\right)w_1+\left(\sum_{i=1}^{I} x_{iJ}x_{i2}\right)w_2+\ldots+\left(\sum_{i=1}^{I} x_{iJ}x_{iJ}\right)w_J=\left(\sum_{i=1}^{I} x_{iJ}y_i\right) \\ \left(\sum_{i=1}^{I} x_{i2}x_{i1}\right)w_1+\left(\sum_{i=1}^{I} x_{i2}x_{i2}\right)w_2+\ldots+\left(\sum_{i=1}^{I} x_{i2}x_{iJ}\right)w_J=\left(\sum_{i=1}^{I} x_{i2}y_i\right) \\ \cdots \\ \left(\sum_{i=1}^{I} x_{iJ}x_{i1}\right)w_1+\left(\sum_{i=1}^{I} x_{iJ}x_{i2}\right)w_2+\ldots+\left(\sum_{i=1}^{I} x_{iJ}x_{iJ}\right)w_J=\left(\sum_{i=1}^{I} x_{iJ}y_i\right) \end{cases}$$

If matrix (covariance matrix) A and vector v are defined as below, and if vector W is defined by equation (1), the normal equation (7) becomes equation (8).

[Equation 8] (8)

$$A=\begin{pmatrix} \sum_{i=1}^{I} x_{iJ}x_{i1} & \sum_{i=1}^{I} x_{iJ}x_{i2} & \cdots & \sum_{i=1}^{I} x_{iJ}x_{iJ} \\ \sum_{i=1}^{I} x_{i2}x_{i1} & \sum_{i=1}^{I} x_{i2}x_{i2} & \cdots & \sum_{i=1}^{I} x_{i2}x_{iJ} \\ & & \cdots & \\ \sum_{i=1}^{I} x_{iJ}x_{i1} & \sum_{i=1}^{I} x_{iJ}x_{i2} & \cdots & \sum_{i=1}^{I} x_{iJ}x_{iJ} \end{pmatrix}$$

$$v=\begin{pmatrix} \sum_{i=1}^{I} x_{iJ}y_i \\ \sum_{i=1}^{I} x_{i2}y_i \\ \vdots \\ \sum_{i=1}^{I} x_{iJ}y_i \end{pmatrix} \quad AW=v$$

The normal equations (7) of the number equal to the number J of the tap coefficient $w_j$ to be determined are written by arranging a predetermined number of sets of learning data $x_{ij}$ and training data $y_i$. By solving equation (8) for vector W (to solve equation (8), matrix A must be regular), an optimum tap coefficient $w_j$ is determined. For example, the sweep method (Gauss-Jordan elimination) may be used to solve equation (8).

In the adaptive process, the determination of an optimum tap coefficient $w_j$ using the learning data and the training data is learned, and the predictive value E[y] close to the training data y is then determined from equation (1) using the tap coefficient $w_j$.

The adaptive process is different from a mere interpolation in that a component, not contained in the low-pitched voice, is reproduced in the high-pitched voice. As long as equation (1) is concerned, the adaptive process appears to be mere interpolation using an interpolation filter. However, the tap coefficient w corresponding to the tap coefficient of the interpolation filter is determined from the training data y using a learning process. The component contained in the high-pitched voice is thus reproduced. The adaptive process may be called a creative process of producing a voice.

In the above example, the predictive value of the high-pitched voice is determined using linear first-order prediction. Alternatively, the predictive value may be determined using two or more equations.

The learning unit 125 shown in FIG. 14 learns, as the quality-enhancement data, the tap coefficient used in the class classifying and adaptive process.

Specifically, a buffer 141 is supplied with the voice data output from an A/D converter 122 (FIG. 3) and serving as data for learning. The buffer 141 temporarily stores the voice data as training data in the learning process.

A learning data generator 142 generates the learning data in the learning process based on the voice data input as the training data stored in the buffer 141.

The learning data generator 142 includes an encoder 142E and a decoder 142D. The encoder 142E has the same construction as that of the encoder 123 in the transmitter 113 (FIG. 3), and encodes the training data stored in the buffer 141 and then outputs encoded voice data as the encoder 123 does. The decoder 142D has the same construction as that of a decoder 161 to be discussed later with reference to FIG. 16, and decodes the encoded voice data using a decoding method corresponding to the encoding method of the encoder 123. The resulting decoded voice data is output as the learning data.

As in the encoder 123, the training data here is converted into the encoded voice data, and the encoded voice data is decoded into the learning data. Alternatively, the voice data as the training data may be degraded in quality to be the learning data, for example, by filtering the voice data through a low-pass filter.

The encoder 123 may be used for the encoder 142E forming the learning data generator 142. The decoder 161 to be discussed later with reference to FIG. 16 may be used for the decoder 142D.

A learning data memory 143 temporarily stores the learning data output from the decoder 142D in the learning data generator 142.

A predictive tap generator 144 successively sets the voice sample of the training data stored in the buffer 141 to be target data, and reads several pieces of voice sample of the learning data from the learning data memory 143 to predict the target data. The predictive tap generator 144 generates the predictive tap (a tap for determining a predictive value of the target data). The predictive tap is fed from the predictive tap generator 144 to a summing unit 147.

A class tap generator 145 reads, from the learning data memory 143, several pieces of voice samples as the learning data to be used to classify the target data, thereby generating a class tap (a tap used for class classifying). The class tap is fed from the class tap generator 145 to a class classifier 146.

The voice sample constituting the predictive tap or the class tap may be a voice sample close in time to the voice sample of the learning data corresponding to the voice sample of the training data serving as the target data.

Alternatively, the voice sample constituting the predictive tap and the class tap may be the same voice sample or different voice samples.

The class classifier 146 classifies the target data according to the class tap from the class tap generator 145, and then outputs a class code corresponding to the resulting class to the summing unit 147.

The class classifying method may be ADRC (Adaptive Dynamic Range Coding) method, or the like.

In the ADRC method, the voice sample forming the class tap is ADRC processed, and in accordance with the resulting ADRC code, the class of the target data is determined.

In K bit ADRC processing, the maximum value MAX and the minimum value MIN of the voice sample forming the class tap are detected. DR=MAX−MIN is a localized dynamic range of a set, and the voice sample forming the class tap is re-quantized to K bits based on the dynamic range DR. Specifically, the minimum value MIN is subtracted from each voice sample forming the class tap, and the remainder value is divided (quantized) by $DR/2^k$. The voice samples of K bits forming the class tap are arranged in a bit train in a predetermined order, and are output as an ADRC code. For example, if a class tap is processed using 1-bit ADRC processing, the minimum value MIN is subtracted from each voice sample forming that class tap and the remainder value is divided by the average of the maximum value MAX and the minimum value MIN. In this way, each voice sample becomes 1 bit (binarized). A bit train in which 1-bit voice samples are arranged in the predetermined order is output as the ADRC code.

The class classifier 146 may output a pattern of level distribution of the voice sample forming the class tap as a class code. If it is assumed that the class tap includes N voice samples, and that K bits are allowed for each voice sample, the number of class codes output from the class classifier 146 becomes $(2^N)^K$. The number of class codes becomes a large number which exponentially increases with bit number K of each voice sample.

The class classifier 146 preferably compresses the amount of information of the class tap using the above-referenced ADRC processing, or vector quantization, before classifying the classes.

The summing unit 147 reads the voice sample of the training data as the target data from the buffer 141, and performs a summing process on the learning data forming the predictive tap from the predictive tap generator 144 and the training data as the target data for each class supplied from the class classifier 146 while using the storage content in each of an initial element memory 148 and a user element memory 149 as necessary.

The summing unit 147 performs multiplication ($x_{in}x_{im}$) of learning data, and a summing operation (Σ) on the resulting product of learning data, using the predictive tap (the learning data) for each class corresponding to the class code supplied from the class classifier 146. The result of the above operation is an element of the matrix A in equation (8).

The summing unit 147 performs multiplication ($x_{in}y_i$) of learning data and training data, and a summing operation (Σ) on the resulting product of the learning data and the training data, using the predictive tap (the learning data) and the target data (the training data) for each class corresponding to the class code supplied from the class classifier 146. The result of the above operation is an element of the matrix v in equation (8).

The initial element memory 148 is formed of a ROM, and stores, on a class-by-class basis, the elements in the matrix A and the elements in the vector v in equation (8), which are obtained from learning, as data for learning, the voice data of unspecified number of speakers prepared beforehand.

The user element memory 149 is formed of an EEPROM, for example, and stores, class by class, the elements in the matrix A and the elements in the vector v in equation (8) determined in a preceding learning process of the summing unit 147.

When newly input voice data is used in the learning process, the summing unit 147 reads the elements in the matrix A and the elements in the vector v in equation (8) determined in the preceding learning process and stored in the user element memory 149. The summing unit 147 then writes the normal equation (8) for each class by adding element $x_{in}x_{im}$ or $x_{in}y_i$, which is calculated using the training data $y_i$ and the learning data $x_{in}$ ($x_{im}$) based on the newly input voice data, to the elements in one of matrix A and the vector v (by performing a summing operation in the matrix A and the vector v).

The summing unit 147 thus writes the normal equation (8) based on not only the newly input voice data but also the voice data used in the past learning process.

If the learning unit 125 performs a learning process for the first time or if the learning unit 125 performs a first learning process subsequent to the clearance of the user element memory 149, the user element memory 149 does not store elements in the matrix A and vector v resulting from a preceding learning process. The normal equation (8) is thus written using only the voice data input by the user.

A class may occur in which normal equations of the number required to determine the tap coefficient are not obtained because of insufficient number of samples of the input voice data.

The initial element memory 148 stores the elements in the matrix A and the elements in the vector v in equation (8), which are obtained from learning, as data for learning, the voice data of unspecified number of speakers prepared beforehand. The learning unit 125 writes the normal equation (8) using the elements in the matrix A and the elements in the vector v stored in the initial element memory 148, and the elements in the matrix A and vector v obtained from the input voice data, as necessary. In this way, the learning unit 125 prevents a class, having insufficient number of normal equations required to determine the tap coefficient, from taking place.

The summing unit 147 newly determines elements in the matrix A and vector v for each class using the elements in the matrix A and vector v obtained from the newly input voice data, and the elements in the matrix A and vector v stored in the user element memory 149 (or the initial element memory 148). The summing unit 147 then supplies the user element memory 149 with these elements, thereby overwriting the existing content.

The summing unit 147 supplies a tap coefficient determiner 150 with the normal equation (8) formed of the elements in the matrix A and vector v newly determined for each class.

The tap coefficient determiner 150 determines the tap coefficient for each class by solving the normal equation for each class supplied from the summing unit 147, and supplies the memory unit 126 with the tap coefficient for each class, as the quality-enhancement data together, with the update-related information, thereby storing these pieces of data in the memory unit 126 in an overwriting fashion.

Figure 15:
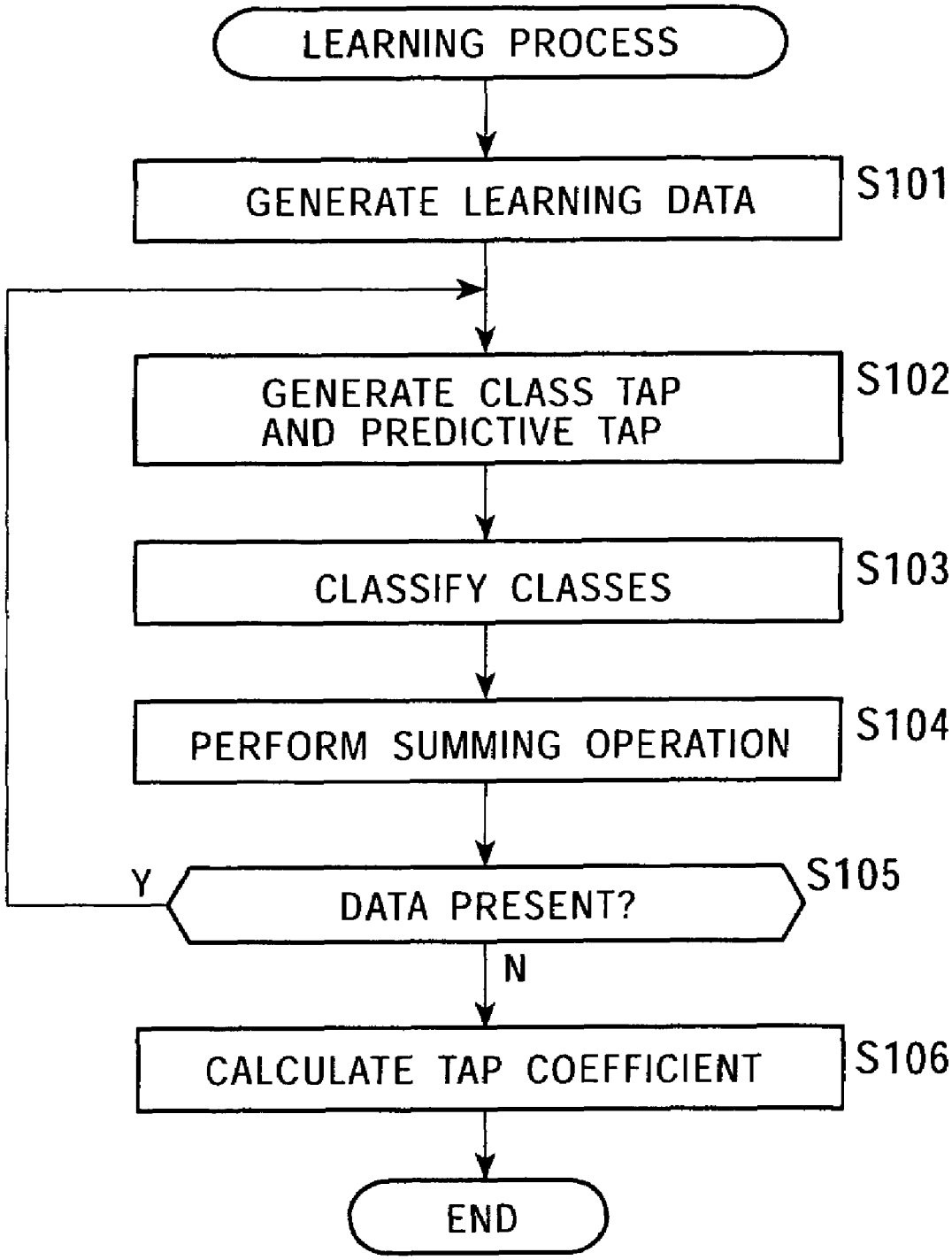
FIG. 15 is a flow diagram illustrating a learning process of the learning unit 125.

A flow diagram shown in FIG. 15 illustrates the learning process performed by the learning unit 125 shown in FIG. 14 to learn the tap coefficient as the quality-enhancement data.

The voice data in response to a voice spoken by the user during a voice communication or at any timing is fed from the A/D converter 122 (FIG. 3) to the buffer 141. The buffer 141 stores the voice data fed thereto.

When the user finishes the voice communication, or when a predetermined duration of time elapses from the beginning of a speech, the learning unit 125 starts the learning process on the voice data stored in the buffer 141 during the voice communication, or on the voice data stored in the buffer 141 from the beginning to the end of a series of voice communications, as the newly input voice data.

In step S101, the learning data generator 142 first generates the learning data from the training data with the voice data stored in the buffer 141 treated as the training data, and supplies the learning data memory 143 with the learning data for storage. The algorithm proceeds to step S102.

In step S102, the predictive tap generator 144 sets, as target data, one of voice samples as the training data stored in the buffer 141, that voice sample not yet treated as target data, and reads several voice samples as the learning data stored in the learning data memory 143 corresponding to the target data. The predictive tap generator 144 generates a predictive tap and then supplies the summing unit 147 with the predictive tap.

Further in step S102, the class tap generator 145 generates a class tap for the target data as the predictive tap generator 144 does, and supplies the class classifier 146 with the class tap.

Subsequent to the process in step S102, the algorithm proceeds to step S103. The class classifier 146 classifies the target data according to the class tap from the class tap generator 145, and feeds the resulting class code to the summing unit 147.

In step S104, the summing unit 147 reads the target data from the buffer 141, and calculates the elements in the matrix A and vector v using the target data and the predictive tap from the predictive tap generator 144. The summing unit 147 adds elements in the matrix A and vector v determined from the target data and the predictive tap to elements, out of the elements in the matrix A and vector v stored in the user element memory 149, corresponding to the class code from the class classifier 146. The algorithm proceeds to step S105.

In step S105, the predictive tap generator 144 determines whether training data not yet treated as target data is present in the buffer 141. If it is determined that such training data is present in the buffer 141, the algorithm loops to step S102. The training data not yet treated as target data is set as new target data, and the same process is repeated.

If it is determined in step S105 that any training data not yet treated as target data is not present in the buffer 141, the summing unit 147 supplies the tap coefficient determiner 150 with the normal equation (8) composed of the elements in the matrix A and vector v stored for each class in the user element memory 149. The algorithm then proceeds to step S106.

In step S106, the tap coefficient determiner 150 determines the tap coefficient for each class by solving the normal equation for each class supplied from the summing unit 147. Further in step S106, the tap coefficient determiner 150 supplies the memory unit 126 with the tap coefficient of each class together with the update-related information, thereby storing these pieces of data in the memory unit 126 in an overwriting fashion. The learning process ends.

The learning process is not performed on a real-time basis here. If hardware has high performance, the learning process may be carried out on a real-time basis.

As described above, the learning unit 125 performs the learning process based on the newly input voice data and the voice data used in the past learning process during the voice communication or at any timing. As the user speaks more, the tap coefficient that decodes a voice closer to the voice of the user is obtained. By decoding the encoded voice data using such a tap coefficient on a communication partner, a process appropriate for the characteristics of the voice of the user is performed. Decoded voice data having sufficiently improved quality is thus obtained. As the user uses the mobile telephone 101 longer, a better quality voice is output from the communication partner side.

When the learning unit 125 in the transmitter 113 (FIG. 3) is constructed as shown in FIG. 14, the quality-enhancement data is the tap coefficient. The memory unit 136 in the receiver 114 (FIG. 4) stores the tap coefficient. The default data memory 137 in the receiver 114 stores, as default data, the tap coefficient for each class which is obtained by solving the normal equation composed of the elements stored in the initial element memory 148 shown in FIG. 14.

Figure 16:
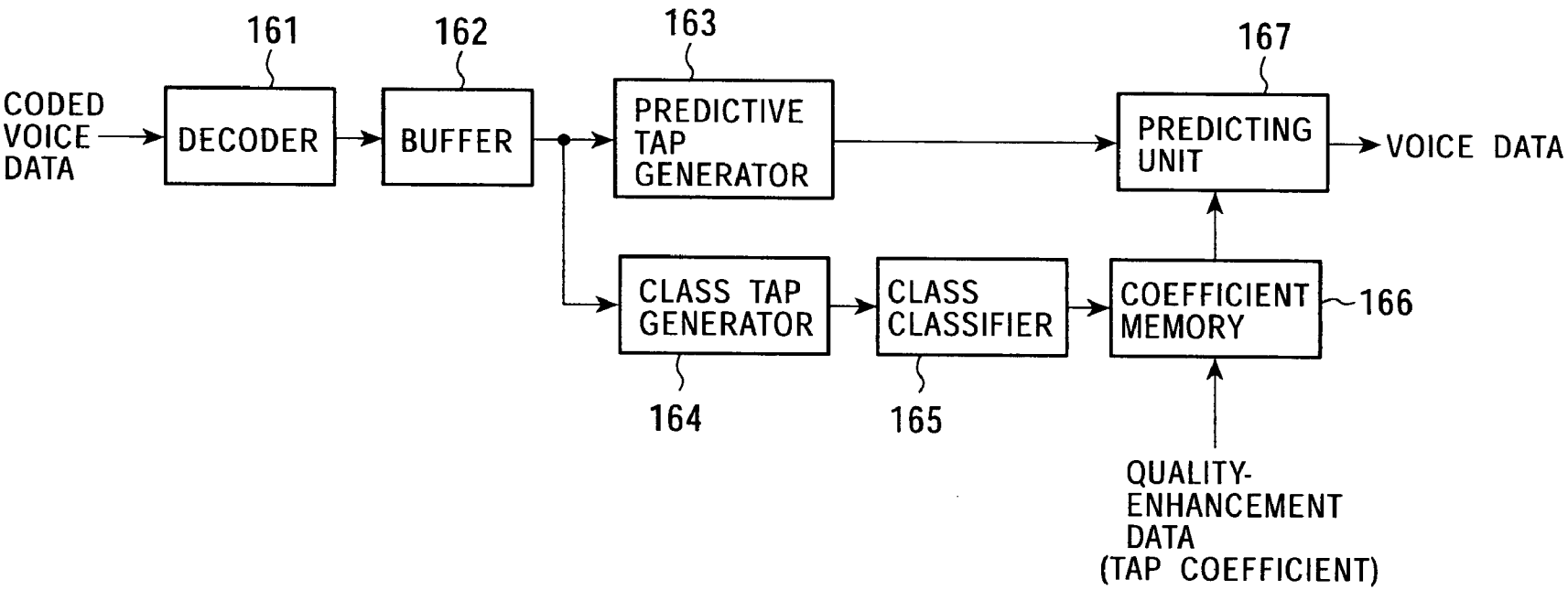
FIG. 16 is a block diagram illustrating the construction of a decoder 132.

FIG. 16 illustrates the construction of the decoder 132 in the receiver 114 (FIG. 4), wherein the learning unit 125 in the transmitter 113 (FIG. 3) is constructed as shown in FIG. 14.

A decoder 161 is supplied with the encoded video data output from the receiver controller 131 (FIG. 4). The decoder 161 decodes the encoded voice data using a decoding method corresponding to the encoding method of the encoder 123 in the transmitter 113 (FIG. 3). The resulting decoded voice data is output to a buffer 162.

The buffer 162 temporarily stores the decoded voice data output from the decoder 161.

A predictive tap generator 163 successively sets the quality-enhancement data for improving the quality of the decoded voice data as target data, and arranges (generates) a predictive tap, which is used to determine the predictive value of the target data using a linear first-order prediction operation of equation (1), with several voice samples of the decoded voice data stored in the buffer 162. The predictive tap is then fed to a predicting unit 167. The predictive tap generator 163 generates the same predictive tap as that generated by the predictive tap generator 144 in the learning unit 125 shown in FIG. 14.

A class tap generator 164 arranges (generates) a class tap for the target data in accordance with several voice samples of the decoded voice data stored in the buffer 162, and supplies a class classifier 165 with the class tap. The class tap generator 164 generates the same class tap as that generated by the class tap generator 145 in the learning unit 125 shown in FIG. 14.

The class classifier 165 performs class classification as that performed by the class classifier 146 in the learning unit 125 shown in FIG. 14, using the class tap from the class tap generator 164, and supplies a coefficient memory 166 with the resulting class code.

The coefficient memory 166 stores the tap coefficient for each class as the quality-enhancement data from the management unit 135 at an address corresponding to the class. Furthermore, the coefficient memory 166 feeds, to the predicting unit 167, the tap coefficient stored at the address corresponding to the class code supplied from the class classifier 165.

The predicting unit 167 acquires the predictive tap output from the predictive tap generator 163 and the tap coefficient output from the coefficient memory 166, and performs a linear prediction calculation as expressed by equation (1) using the predictive tap and the tap coefficient. The predicting unit 167 determines (a predictive value of) voice-quality improved data as the target data, and supplies the D/A converter 133 (FIG. 4) with the voice-quality improved data.

Figure 17:
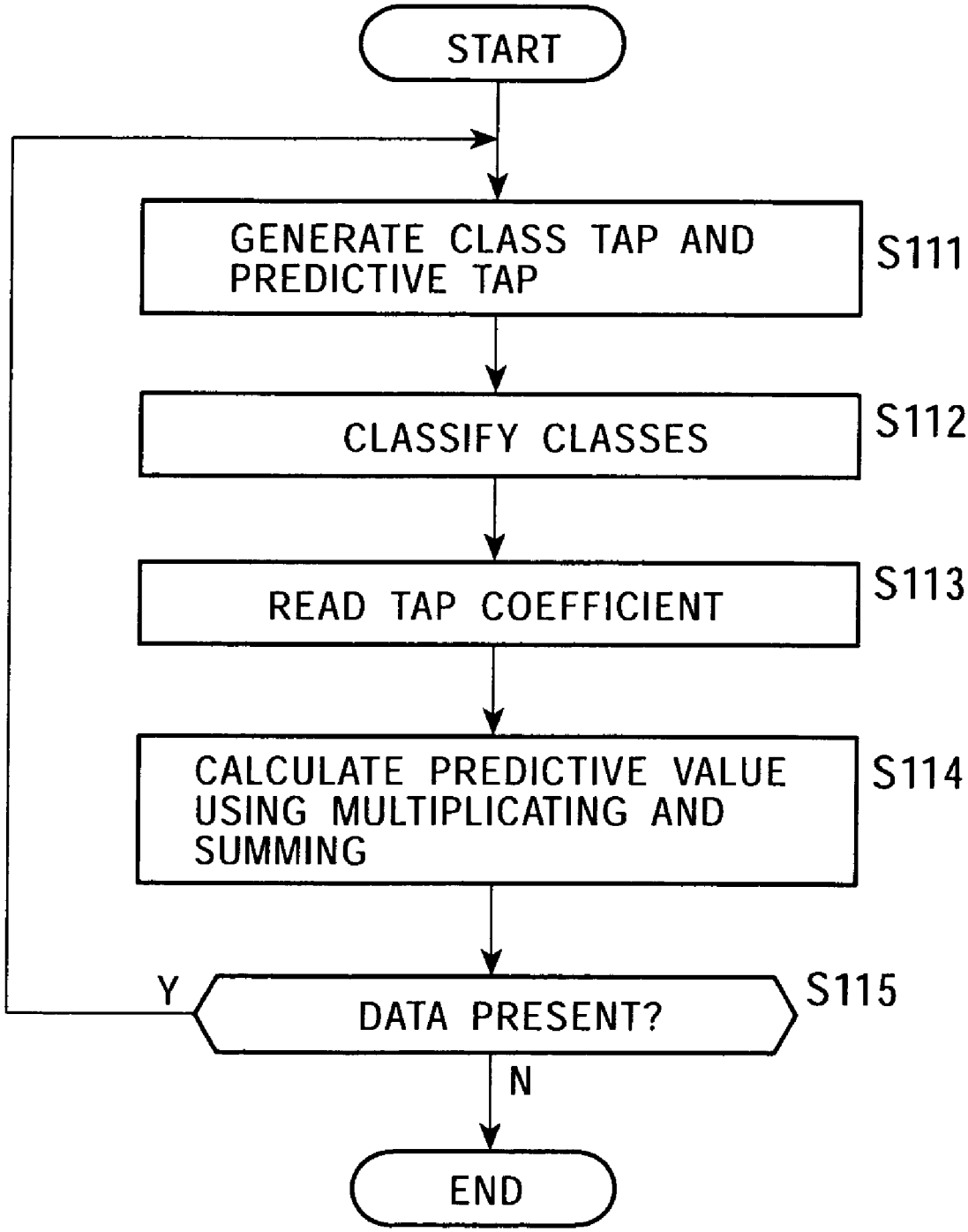
FIG. 17 is a flow diagram illustrating a process of the decoder 132.

The process of the decoder 132 shown in FIG. 16 is discussed with reference to a flow diagram shown in FIG. 17.

The decoder 161 decodes the encoded voice data output from the receiver controller 131 (FIG. 4), and then outputs and stores the resulting decoded voice data in the buffer 162.

In step S111, the predictive tap generator 163 sets, as target data, the earliest voice sample in time scale not yet treated as target data, out of voice-quality improved data that has been improved in the sound quality of the decoded voice data, and arranges a predictive tap by reading several sound samples of the decoded voice data from the buffer 162, with respect to the target data, and then feeds the predictive tap to the predicting unit 167.

Also in step S111, the class tap generator 164 arranges a class tap by reading several voice samples of the decoded voice data stored in the buffer 162 with respect to the target data, and supplies the class classifier 165 with the class tap.

Upon receiving the class tap from the class tap generator 164, the class classifier 165 performs class classification using the class tap in step S112. The class classifier 165 supplies the coefficient memory 166 with the resulting class code, and then the algorithm proceeds to step S113.

In step S113, the coefficient memory 166 reads the tap coefficient stored at the address corresponding to the class code output from the class classifier 165, and then supplies the predicting unit 167 with the read tap coefficient. The algorithm proceeds to step S114.

In step S114, the predicting unit 167 acquires the tap coefficient output from the coefficient memory 166, and performs a multiplication and summing operation expressed by equation (1) using the acquired tap coefficient and the predictive tap from the predictive tap generator 163, thereby resulting in (the predictive value of) the voice-quality improved data.

The voice-quality improved data thus obtained is fed from the predicting unit 167 to the loudspeaker 134 through the D/A converter 133 (FIG. 4), and a high-quality voice is then output from the loudspeaker 134.

The tap coefficient is obtained by learning the relationship between a trainee and a trainer wherein the voice of the user functions as the trainer and the encoded and then decoded version of that voice functions as the trainee. The voice of the user is precisely predicted from the decoded voice data output from the decoder 161. The loudspeaker 134 thus outputs a voice more closely resembling the real voice of the user as the voice communication partner, namely, the decoded voice data having high quality output from the decoder 161 (FIG. 16).

Subsequent to the process step in step S114, the algorithm proceeds to step S115. It is determined whether there is voice-quality improved data to be processed as target data. If it is determined that there is voice-quality improved data to be treated as target data, the above series of steps is repeated again. If it is determined in step S115 that there is no voice-quality improved data to be treated as target data, the algorithm ends.

When a voice communication is performed between the mobile telephone $\mathbf{101}_1$ and the mobile telephone $\mathbf{101}_2$, the mobile telephone $\mathbf{101}_2$ uses the tap coefficient as the quality-enhancement data correspondingly associated with the telephone number of the mobile telephone $\mathbf{101}_1$ which is a voice communication partner as illustrated in FIG. 5, in other words, uses the learned data of the voice data of the user of the mobile telephone $\mathbf{101}_1$. If a voice transmitted from the mobile telephone $\mathbf{101}_1$ to the mobile telephone $\mathbf{101}_2$ is the voice of the user of the mobile telephone $\mathbf{101}_1$, the mobile telephone $101_2$ performs a decoding process using the tap coefficient of the user of the mobile telephone $101_1$, thereby outputting a high-quality voice.

Even if a voice transmitted from the mobile telephone $101_1$ to the mobile telephone $101_2$ is not the voice of the user of the mobile telephone $101_1$, in other words, even if the mobile telephone $101_1$ is used by another person other than the user or owner of the mobile telephone $101_1$, the mobile telephone $101_2$ performs a decoding process using the tap coefficient of the user of the mobile telephone $101_1$. The voice obtained from the decoding process is not better in quality than the voice which is obtained from the voice of the real user (owner) of the mobile telephone $101_1$. In summary, the mobile telephone $101_2$ outputs a high-pitched voice if the owner uses the mobile telephone $101_1$, and does not output a high-pitched voice if a user other than the owner of the mobile telephone $101_1$ uses the mobile telephone $101_1$. In this regard, the mobile telephone 101 functions for simple individual authentication.

Figure 18:
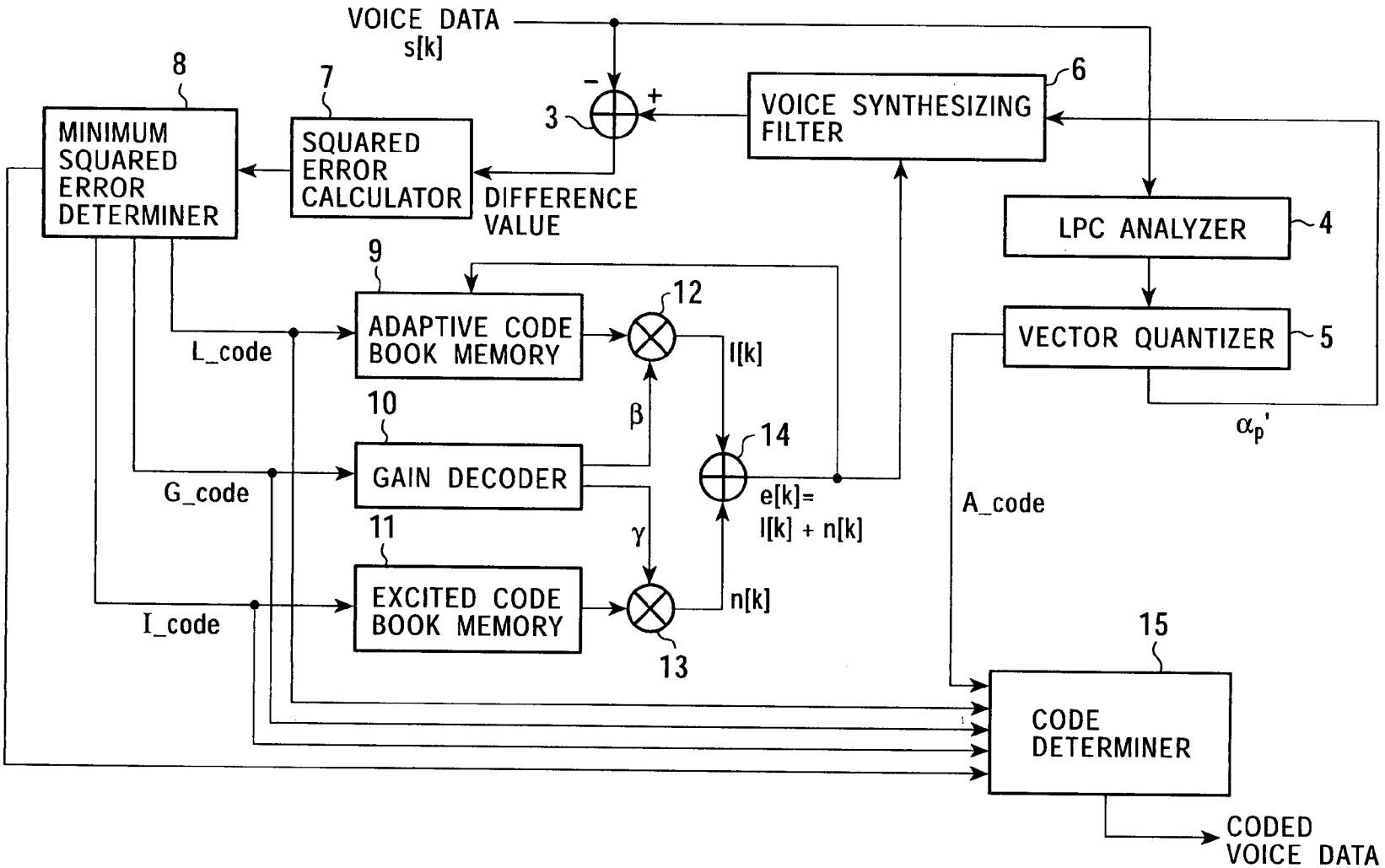
FIG. 18 is a block diagram illustrating the construction of a CELP encoder 123.

FIG. 18 illustrates the construction of the encoder 123 forming the transmitter 113 (FIG. 3) in a CELP (Code Excited Linear Prediction Coding) type mobile telephone 101.

The voice data output from the A/D converter 122 (FIG. 3) is fed to a calculator 3 and an LPC (Liner Prediction Coefficient) analyzer 4.

The LPC analyzer 4 LPC-analyzes the voice data from the A/D converter 122 (FIG. 3) frame by frame with a predetermined voice sample treated as one frame, thereby resulting in P-th order linear prediction coefficients $\alpha_1, \alpha_2, \ldots, \alpha_P$. The LPC analyzer 4 supplies a vector quantizer 5 with a feature vector having P-th order linear coefficients $\alpha_P$ (p=1, 2, . . . , P) as elements.

The vector quantizer 5 stores a code vector having the linear prediction coefficients as the elements thereof, and a code book correspondingly associated with a code, and vector-quantizes the feature vector $\alpha$ from the LPC analyzer 4 based on the code book, and then outputs a code obtained as a result of vector quantization (hereinafter referred to as A_code) to a code determiner 15.

The vector quantizer 5 supplies a voice synthesizing filter 6 with the linear prediction coefficients $\alpha_1', \alpha_2', \ldots, \alpha_P'$ working as the elements constituting the code vector $\alpha'$ corresponding to the A code.

The voice synthesizing filter 6, which is an IIR (Infinite Impulse Response) type digital filter, performs voice synthesis with the linear prediction coefficient $\alpha_P'$ (p=1, 2, . . . , P) from the vector quantizer 5 treated as the tap coefficient for the IIR filter and the remainder signal e supplied from a calculator 14 treated as an input signal. In the LPC analysis performed by the LPC analyzer 4, let $s_n$ represent (the sample value of) the voice data at current time n, and $S_{n-1}, S_{n-2}, \ldots, s_{n-P}$ represent past P sample values adjacent to $s_n$, and it is assumed that the following first order linear prediction combination expressed by equation (9) holds.

$$s_n+\alpha_1 s_{n-1}+\alpha_2 s_{n-2}+\ldots+\alpha_P s_{n-P}=e_n \tag{9}$$

The predictive value (linear predictive value) $s_n'$ of the sample value $s_n$ at current time n is expressed as below using past P sample values $s_{n-1}, s_{n-2}, \ldots, s_{n-P}$, $$s_n'=-(\alpha_1 s_{n-1}+\alpha_2 s_{n-2}+\ldots+\alpha_P s_{n-p}) \tag{10}$$

The linear prediction coefficient $\alpha_P$ is thus determined so that a squared error between the actual sample value $s_n$ and the linear prediction value $s_n'$ is minimized.

In equation (9), $\{e_n\}$ ( . . . , $e_{n-1}, e_n, e_{n+1}, \ldots$ ) are non-correlated random variables. The average of the random variables are zero and the variance thereof is $\sigma_2$.

From equation (9), the sample value $s_n$ is $$s_n=e_n-(\alpha_1 s_{n-1}+\alpha_2 s_{n-2}+\ldots+\alpha_P s_{n-P}) \tag{11}$$

If Z transformed, equation (11) becomes equation (12).

$$S=E/(1+\alpha_1 z^{-1}+\alpha_2 z^{-2}+\ldots\alpha_P z^{-P}) \tag{12}$$

In equation (12), S and E respectively represent Z transformed versions of $s_n$ and $e_n$ in equation (11).

From equations (9) and (10), $e_n$ is $$e_n=s_n-s_n' \tag{13}$$

The difference between the actual sample value $s_n$ and the linear predictive value $s_n'$ is referred to as the remainder signal.

From equation (12), the voice data $s_n$ is determined by setting the linear prediction coefficient $\alpha_P$ to be the tap coefficient of the IIR filter, and the remainder signal $e_n$ to be the input signal of the IIR filter.

As described above, the voice synthesizing filter 6 calculates equation (12) by setting the linear prediction coefficient $\alpha_P'$ from the vector quantizer 5 to be the tap coefficient, and the remainder signal e supplied from the calculator 14 to be the input signal, and thus determines voice data (synthesized sound data) ss.

Since the voice synthesizing filter 6 uses the linear prediction coefficient $\alpha_P'$ as the code vector corresponding to the code obtained as a result of vector quantization, rather than the linear prediction coefficient $\alpha_P$ obtained as a result of LPC analysis of the LPC analyzer 4, the synthesized sound signal output from the voice synthesizing filter 6 is basically not identical to the voice data output from the A/D converter 122 (FIG. 3).

The synthesized sound data ss output from the voice synthesizing filter 6 is fed to the calculator 3. The calculator 3 subtracts the voice data s output from the A/D converter 122 (FIG. 3) from the synthesized sound data ss from the voice synthesizing filter 6, and feeds the resulting remainder to a squared error calculator 7. The squared error calculator 7 sums squared remainders from the calculator 3 (squared sample values in a k-th frame), and feeds the resulting squared errors to a minimum squared error determiner 8.

The minimum squared error determiner 8 stores, in corresponding association with the squared error output from the squared error calculator 7, an L code (L_code) as a code expressing a long-term prediction lag, a G code (C_code) as a code expressing gain, and I code (I_code) as a code expressing a code word (excited code book), and outputs the L code, G code, and L code corresponding to the squared error output from the squared error calculator 7. The L code is fed to an adaptive code book memory 9, the G code is fed to a gain decoder 10, and the I code is fed to an excited code book memory 11. The L code, G code and I code are also fed to the code determiner 15.

The adaptive code book memory 9 stores a 7 bit L code, and an adaptive code book correspondingly associated with a predetermined delay time (lag), and delays the remainder signal e supplied from the calculator 14 by delay time (long-term prediction lag) correspondingly associated with the L code supplied from the minimum squared error determiner 8. The delayed remainder signal e is then fed to a calculator 12.

Since the adaptive code book memory 9 delays the remainder signal e by the time corresponding to the L code before outputting the remainder signal e, the output signal becomes a signal close to a signal having the period equal to the delay time. That signal mainly works as a driving signal for generating a synthesized signal of voiced sound in voice synthesis using the linear prediction coefficient. The L code expresses the pitch period of the voice. According to the CELP standard, the code is an integer value falling within a range of from 20 through 146.

The gain decoder 10 stores a table that correspondingly associates the G code with predetermined gains β and γ, and outputs the gain α and gain γ in corresponding association with the G code output from the minimum squared error determiner 8. The gains β and γ are respectively fed to calculators 12 and 13. The gain β is referred to as long-term filter state output gain, and the gain γ is referred to as excited code book gain.

The excited code book memory 11 stores a 9 bit I code and an excited code book correspondingly associated with a predetermined excitation signal, for example, and outputs, to a calculator 13, an excitation signal correspondingly associated with the I code supplied from the minimum squared error determiner 8.

The excitation signal stored in the excited code book is a signal almost equal to white noise, and becomes a driving signal for generating mainly a synthesized signal of unvoiced sound in the voice synthesis using the linear prediction coefficient.

The calculator 12 multiplies the output signal from the adaptive code book memory 9 by the gain β output from the gain decoder 10, and outputs the product 1 to the calculator 14. The calculator 13 multiplies the output signal of the excited code book memory 11 by the gain γ output from the gain decoder 10, and outputs the product n to the calculator 14. The calculator 14 sums the product 1 from the calculator 12 and the product n from the calculator 13, and supplies the voice synthesizing filter 6 and the adaptive code book memory 9 with the sum of these products as the remainder signal e.

The voice synthesizing filter 6 functions as an IIR filter having the linear prediction coefficient $\alpha_P'$ supplied from the vector quantizer 5 as the tap coefficient. The voice synthesizing filter 6 filters the input signal, namely, the remainder signal e supplied from the calculator 14, and feeds the calculator 3 with the resulting synthesized sound data. The calculator 3 and the squared error calculator 7 perform the same process as the one already discussed, and the resulting squared error is then fed to the minimum squared error determiner 8.

The minimum squared error determiner 8 determines whether the squared error from the squared error calculator 7 is minimized (to minimality). If the minimum squared error determiner 8 determines that the squared error is not minimized, the minimum squared error determiner 8 outputs the L code, G code, and L code, and then the same process as the one already discussed will be repeated.

If the minimum squared error determiner 8 determines that the squared error is minimized, the minimum squared error determiner 8 outputs a determination signal to the code determiner 15. The code determiner 15 latches the A code supplied from the vector quantizer 5, and also successively latches the L code, G code, and I code supplied from the minimum squared error determiner 8. Upon receiving the determination signal from the minimum squared error determiner 8, the code determiner 15 multiplexes the latched A code, L code, G code, and I code, and outputs the multiplexed codes as encoded voice data.

From now on, the encoded voice data contains the A code, L code, G code, and I code, namely, information for use in a decoding process, on a per frame basis.

Referring to FIG. 18 (also FIG. 19 and FIG. 20), symbol [k], attached to each variable, represents the number of frames, and is omitted in the specification.

Figure 19:
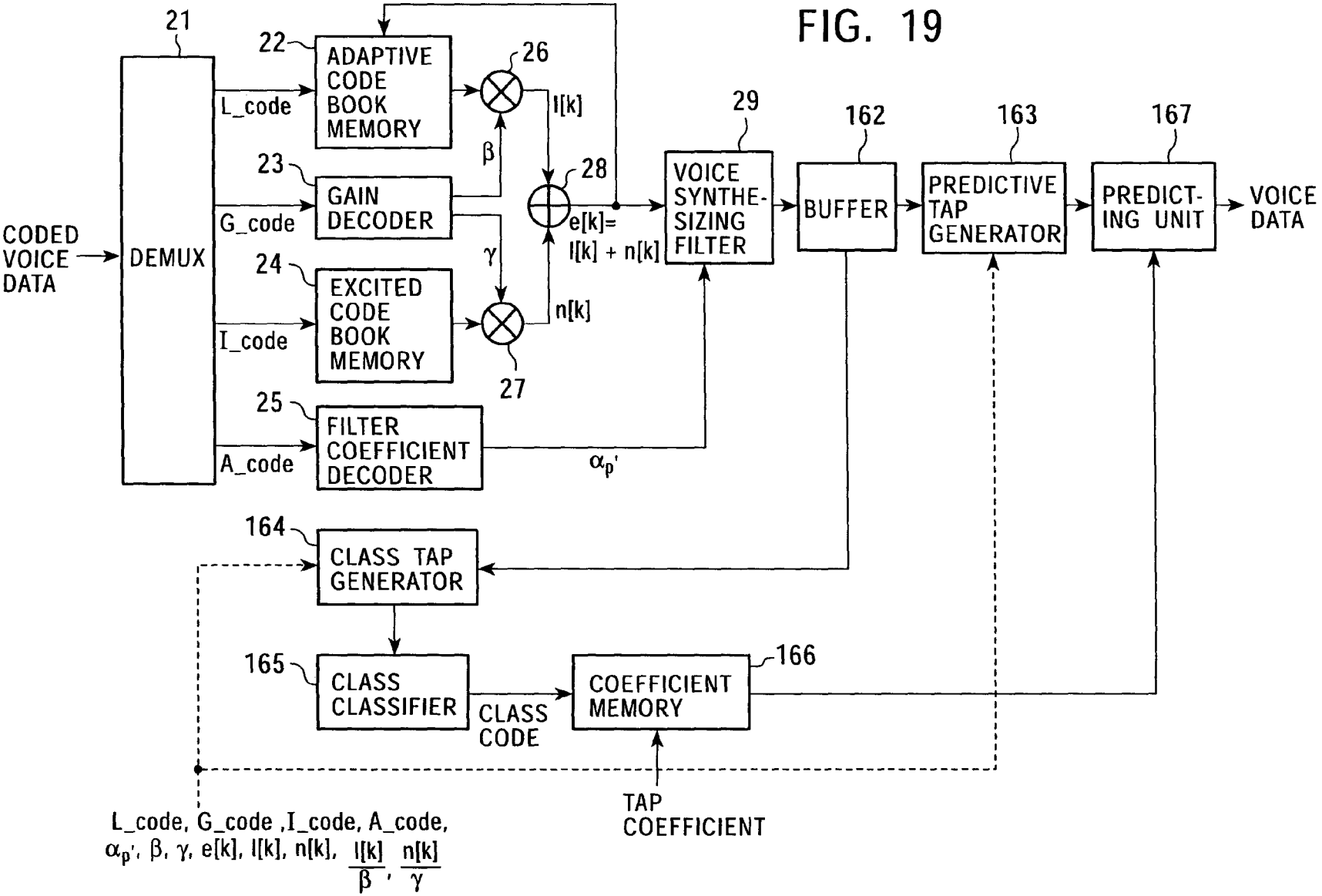
FIG. 19 is a block diagram illustrating the construction of the decoder 132 with the CELP encoder 123 employed.

FIG. 19 illustrates the construction of the decoder 132 forming the receiver 114 (FIG. 4) in a CELP type mobile telephone 101. As shown, components identical to those discussed with reference to FIG. 16 are designated with the same reference numerals.

The encoded voice data output from the receiver controller 131 (FIG. 4) is fed to a DEMUX (demultiplexer) 21. The DEMUX 21 demultiplexes the encoded voice data into the L code, G code, I code, and A code, and supplies an adaptive code book memory 22, gain decoder 23, excited code book memory 24, and filter coefficient decoder 25 respectively with the L code, G code, I code, and A code.

The adaptive code book memory 22, gain decoder 23, excited code book memory 24, and calculators 26 through 28 are respectively identical in construction to the adaptive code book memory 9, gain decoder 10, excited code book memory 11, and the calculators 12 through 14 shown in FIG. 18. The same process as the one discussed with reference to FIG. 1 is performed. The L code, G code, and I code are decoded into the remainder signal e. The remainder signal e is fed as an input signal to a voice synthesizing filter 29.

The filter coefficient decoder 25 stores the same code book as that stored in the vector quantizer 5 shown in FIG. 18, and decodes the A code into the linear prediction coefficient $\alpha_P'$ and supplies the voice synthesizing filter 29 with the linear prediction coefficient $\alpha_P'$.

The voice synthesizing filter 29, having the same construction as that of the voice synthesizing filter 6 shown in FIG. 18, calculates equation (12) by setting the linear prediction coefficient $\alpha_P'$ from the filter coefficient decoder 25 to be a tap coefficient and by setting the remainder signal e supplied from the calculator 28 to be a signal input thereto. The voice synthesizing filter 29 thus generates synthesized sound data when the minimum squared error determiner 8 shown in FIG. 18 determines that the squared error is minimized, and outputs the synthesized sound data as encoded voice data.

As discussed with reference to FIG. 18, the encoder 123 on the calling side transmits the remainder signal and the linear prediction coefficient in encoded form as input signals to the decoder 132 on the called side. The decoder 132 decodes the received code into the remainder signal and the linear prediction coefficient. However, since the remainder signal and the linear prediction coefficient in the decoded form (hereinafter referred to as the decoded remainder signal and decoded linear prediction coefficient as appropriate) contain errors such as quantization error, the decoded remainder signal and linear prediction coefficient fail to coincide with the remainder signal and linear prediction coefficient obtained from LPC analysis of the user voice on the calling side.

The decoded voice data, which is the synthesized sound data output from the voice synthesizing filter 29 of the decoder 132, is degraded in sound quality having distortion in comparison with the voice data of the user on the calling side.

The decoder 132 performs the above-referenced class classifying and adaptive process, thereby converting the decoded voice data into voice-quality improved data close to the voice data of the user on the calling side and free from distortion (or with distortion reduced).

The decoded voice data, which is the synthesized sound data output from the voice synthesizing filter 29, is fed to the buffer 162 for temporary storage there.

The predictive tap generator 163 successively sets the voice-quality improved data, which is the decoded voice data with the quality thereof improved, as target data, and arranges, for the target data, a predictive tap by reading several voice samples of the decoded voice data from the buffer 162, and feeds the predicting unit 167 with the predictive tap. The class tap generator 164 arranges a class tap for the target data by reading several voice samples of the decoded voice data stored in the buffer 162, and supplies the class classifier 165 with the class tap.

The class classifier 165 performs class classification using the class tap from the class tap generator 164, and then supplies the coefficient memory 166 with the resulting class code. The coefficient memory 166 reads a tap coefficient stored at an address corresponding to the class code from the class classifier 165, and supplies the predicting unit 167 with the tap coefficient.

The predicting unit 167 performs a multiplication and summing operation defined by equation (1) using the tap coefficient output from the coefficient memory 166 and the predictive tap from the predictive tap generator 163, and then acquires (the predictive value of) the voice-quality improved data.

The voice-quality improved data thus obtained is output from the predicting unit 167 to the loudspeaker 134 through the D/A converter 133 (FIG. 4), and a high-quality voice is then output from the loudspeaker 134.

Figure 20:
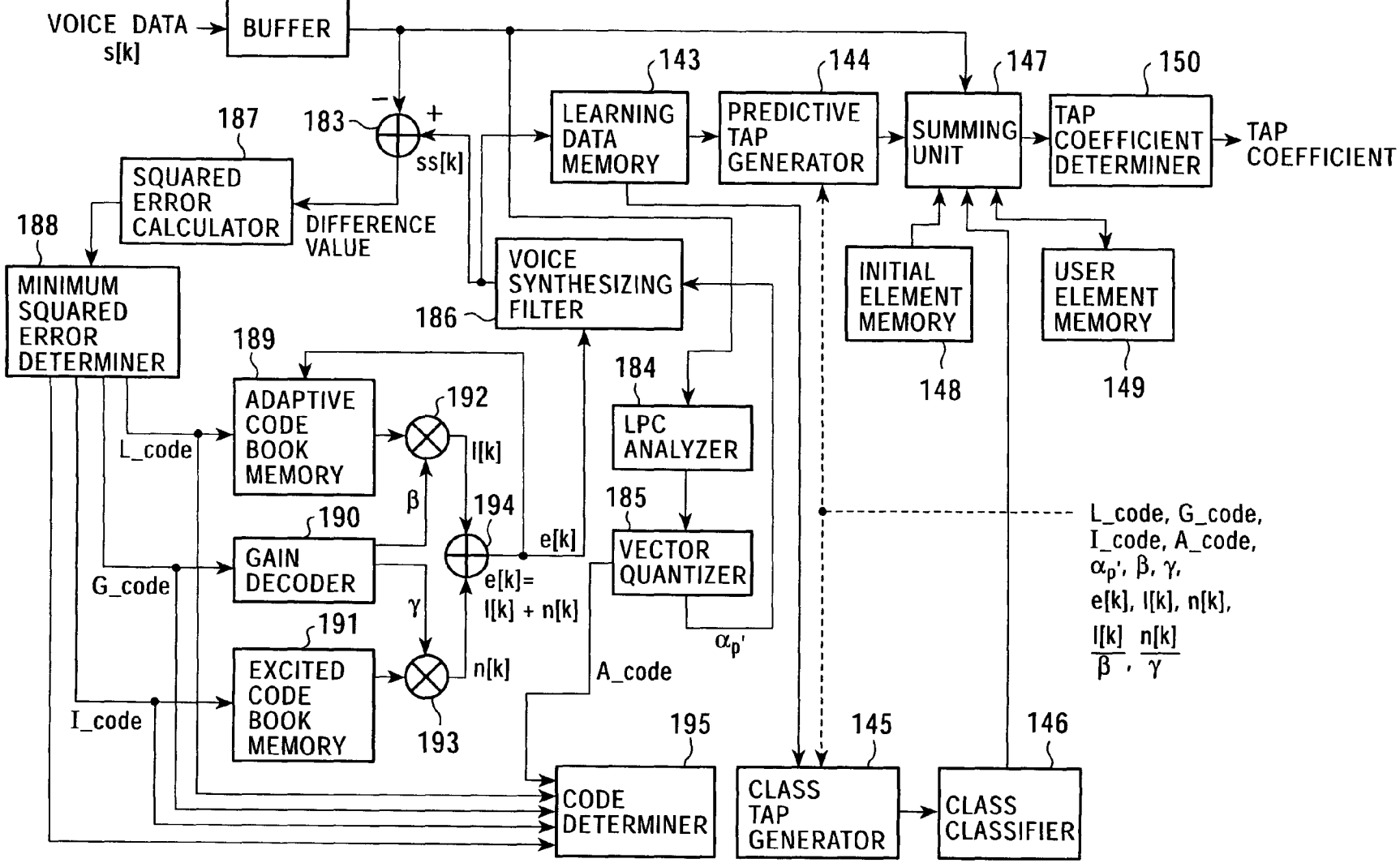
FIG. 20 is a block diagram illustrating the construction of the learning unit 125 with the CELP encoder 123 employed.

FIG. 20 illustrates the construction of the learning unit 125 forming the transmitter 113 (FIG. 3) in a CELP type mobile telephone 101. As shown, components identical to those described with reference to FIG. 14 are designated with the same reference numerals, and the discussion thereof is omitted as appropriate.

A calculator 183 through a code determiner 195 are identical in construction to the calculator 3 through the code determiner 15 illustrated in FIG. 18. The calculator 183 receives the voice data output from the A/D converter 122 (FIG. 3) as data for learning. The calculator 183 through the code determiner 195 perform the same process on the data for learning as that performed by the encoder 123 shown in FIG. 18.

The synthesized sound data, which is output from a voice synthesizing filter 186 when a minimum squared error determiner 188 determines that the squared error is minimized, is stored as learning data in the learning data memory 143.

The learning data memory 143 through the tap coefficient determiner 150 perform the same process as that discussed with reference to FIG. 14 and FIG. 15. In this way, the tap coefficient for each class is generated as the quality-enhancement data.

In each of the embodiments discussed with reference to FIG. 19 and FIG. 20, the predictive tap and the class tap are formed of the synthesized sound data output from the voice synthesizing filter 29 or 186. As represented by dotted lines in FIG. 19 and FIG. 20, each of the predictive tap and the class tap may contain at least one of the linear prediction coefficient $\alpha_p$ resulting from the I code, L code, G code, A code, or A code, the gains β and γ resulting from the G code, and other information obtained from the L code, G code, I code, or A code (for example, the remainder signal e, l and n for determining the remainder signal e, or 1/β or n/γ)

Figure 21:
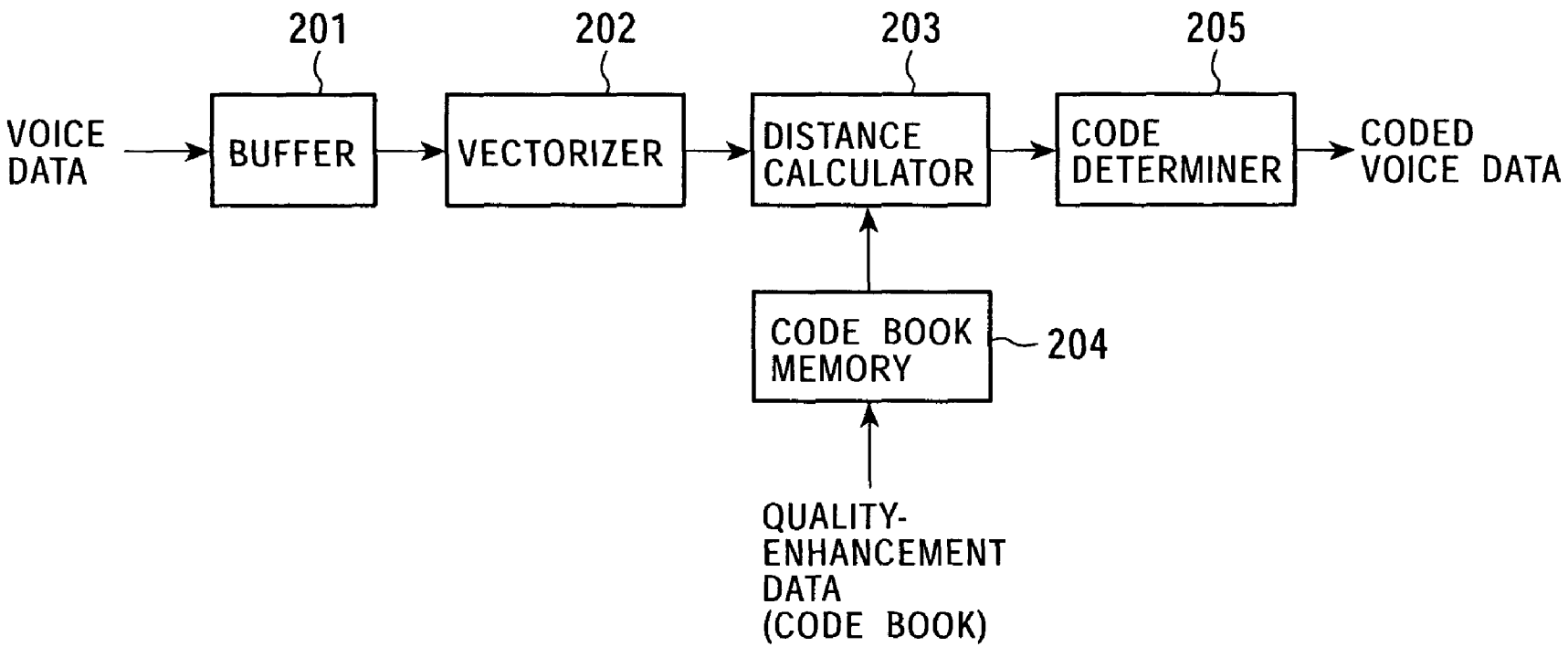
FIG. 21 is a block diagram illustrating the construction of the encoder 123 that perform vector quantization.

FIG. 21 illustrates another construction of the encoder 123 forming the transmitter 113 (FIG. 3).

In the embodiment illustrated in FIG. 21, the encoder 123 encodes the voice data output from the A/D converter 122 (FIG. 3) using vector quantization.

Specifically, the voice data output from the A/D converter 122 (FIG. 3) is fed to a buffer 201 for temporary storage there.

A vectorizer 202 reads the voice data sequentially in time scale stored in the buffer 201, and vectorizes the voice data frame by frame, wherein voice samples of a predetermined number are treated as 1 frame.

The vectorizer 202 may vectorize the voice data by setting directly one frame of voice samples to be elements in a vector. Alternatively, the voice data may be vectorized by subjecting one frame of voice samples to acoustic analysis such as LPC analysis, and by setting the resulting feature quantities of the voice to be elements of a vector. For simplicity of explanation, the voice data is vectorized by setting one frame of voice samples directly to be elements of the vector.

The vectorizer 202 outputs, to a distance calculator 203, a vector which is constructed by setting one frame of voice samples directly to be elements thereof (hereinafter, the vector is also referred to as a voice vector).

The distance calculator 203 calculates a distance (for example, an Euclidean distance) between each code vector registered in the code book stored in a code book memory 204 and the voice vector from the vectorizer 202, and supplies a code determiner 205 with the distance determined for each code vector together a code correspondingly associated with that code vector.

The code book memory 204 stores the code book, as the quality-enhancement data which is obtained from the learning process by the learning unit 125 shown in FIG. 22 to be discussed later. The distance calculator 203 calculates a distance between each code vector registered in that code book and the voice vector from the vectorizer 202, and supplies the code determiner 205 with the distance and a code correspondingly associated with the code vector.

The code determiner 205 detects the shortest distance from among the distances of the code vectors supplied from the distance calculator 203, and determines a code of the code vector resulting in the shortest distance, namely, the code vector that minimizes quantization error (vector quantization error) of the voice vector, to be a vector quantization result for the voice vector output from the vectorizer 202. The code determiner 205 outputs, to the transmitter controller 124 (FIG. 3), the code as a result of the vector quantization as the encoded voice data.

In the embodiment illustrated in FIG. 21, the distance calculator 203, code book memory 204, and code determiner 205 forms a vector quantizer block.

Figure 22:
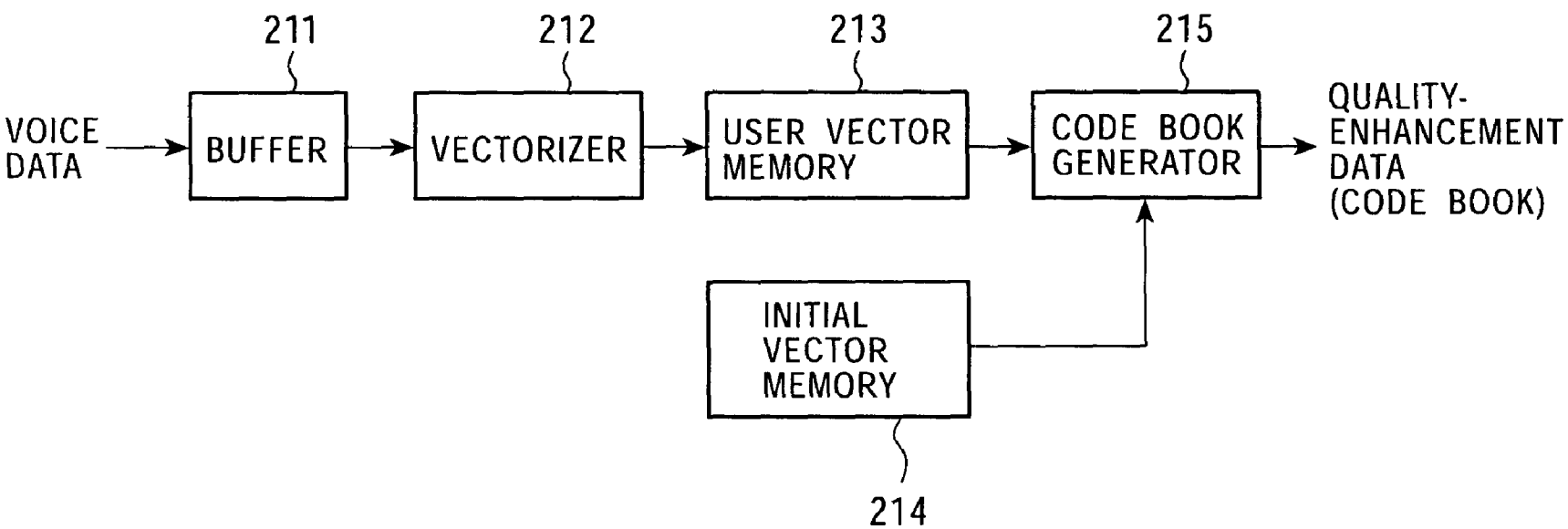
FIG. 22 is a block diagram illustrating the construction of the learning unit 125 wherein the encoder 123 performs vector quantization.

FIG. 22 illustrates the construction of the learning unit 125 forming the transmitter 113 illustrated in FIG. 3 wherein the encoder 123 is constructed as illustrated in FIG. 21.

A buffer 211 receives and stores the voice data output from the A/D converter 122.

Like the vectorizer 202 shown in FIG. 21, a vectorizer 212 constructs a voice vector using the voice data stored in the buffer 211, and feeds the voice vector to a user vector memory 213.

The user vector memory 213, formed of an EEPROM, for example, successively stores the voice vector supplied from the vectorizer 212. An initial vector memory 214, formed of a ROM, for example, stores beforehand a number of voice vectors that are constructed of the voice data of unspecified number of users.

A code book generator 215 performs a learning process to generate a code book based on all voice vectors stored in the initial vector memory 214 and the user vector memory 213 using the LBG (Linde, Buzo, Gray) algorithm, and outputs the code book obtained as a result of the learning process as the quality-enhancement data.

The code book as the quality-enhancement data output from the code book generator 215 is fed to the memory unit 126 (FIG. 3), and is stored together with the update-related information (the date and time at which the code book is obtained) in the memory unit 126. The code book is also fed to the encoder 123 (FIG. 21) to be written on the code book memory 204 in the encoder 123 (in an overwrite fashion).

If the learning unit 125 in FIG. 22 performs the learning process for the first time, or performs the learning process immediately subsequent to the clearance of the user vector memory 213, the user vector memory 213 stores no voice vectors. The code book generator 215 cannot generate the code book by referencing merely the user vector memory 213. The number of voice vectors stored in the user vector memory 213 is not so many in the initial period from the start of use of the mobile telephone 101. In this case, the code book generator 215 may generate the code book by referencing merely the user vector memory 213, but the vector quantization using such a code book may suffer from low accuracy (with a large quantization error).

As described above, the initial vector memory 214 stores a number of voice vectors. The code book generator 215 prevents a code book resulting in low-accuracy vector quantization from being generated, by referencing not only the user vector memory 213 but also the initial vector memory 214.

In code book generation, the code book generator 215 references the user vector memory 213 only rather than referencing the initial vector memory 214 after a considerable number of voice vectors is stored in the user vector memory 213.

The learning process of the learning unit 125 illustrated in FIG. 22 for learning the code book as the quality-enhancement data is discussed with reference to a flow diagram illustrated in FIG. 23.

The voice data of the voice the user speaks during voice communication or at any timing is fed to the buffer 211 from the A/D converter 122 (FIG. 3), and the buffer 211 stores the voice data fed thereto.

When the user finishes the voice communication, or when a predetermined time has elapses from the beginning of the voice communication, the learning unit 125 starts the learning process on the newly input voice data, which is the voice data stored in the buffer 211 during the voice communication or the voice data stored in the buffer 211 from the beginning to the end of the voice communication.

The vectorizer 212 sequentially reads the voice data stored in the buffer 211, and vectorizes the voice data frame by frame, wherein one frame is constructed of a predetermined number of voice samples. The vectorizer 212 feeds the voice vector obtained as a result of vectorization to the user vector memory 213 for additional storage.

When the vectorization of all voice data stored in the buffer 211 is completed, the code book generator 215 determines a vector $y_1$ which minimizes the sum of distances of the vector $y_1$ to the voice vectors stored in the user vector memory 213 and the initial vector memory 214 in step S121. The code book generator 215 sets the vector $y_1$ to be a code vector $y_1$. Then, the algorithm proceeds to step S122.

In step S122, the code book generator 215 sets the total number of currently available code vectors to be a variable n, and splits each of the code vectors $y_1, y_2, \ldots, y_n$ into two. Specifically, let Δ represent an infinitesimal vector, and the code book generator 215 generates vectors $y_i+\Delta$ and $y_i-\Delta$ from a code vector $y_i$ (i=1, 2, . . . , n), and sets the vector $y_i+\Delta$ as a new code vector $y_i$ and the vector $y_i-\Delta$ as a new code vector $Y_{n+i}$.

In step S123, the code book generator 215 classifies the voice vectors $x_j$ (j=1, 2, . . . , J (the total number of voice vectors stored in the user vector memory 213 and the initial vector memory 214)) as the code vector $y_i$ (i=1, 2, . . . , 2n) which is closest in distance to the voice vector $x_j$, and the algorithm proceeds to step S124.

In step S124, the code book generator 215 updates the code vector $y_i$ so that the sum of the distances classified for the code vector $y_i$ is minimized. This updating process may be carried out by determining the center of gravity of points to which zero or more voice vectors classified for the code vector $y_i$ point. In other words, the vector pointing to the gravity minimizes the sum of distances of the voice vectors classified for the code vector $y_i$. If the voice vectors classified for the code vector $y_i$ is zero, the code vector $y_i$ remains unchanged.

In step S125, the code book generator 215 determines the sum of the distances of the voice vectors classified for the updated code vector $y_i$ (hereinafter referred to as the sum of distances with respect to the code vector $y_i$), and then determines the total sum of the sums of all code vectors $y_i$ (hereinafter referred to as the total sum) The code book generator 215 determines whether a change in the total sum, namely, the absolute value of a difference between the total sum determined in current step S125 (hereinafter referred to a current total sum) and the total sum determined in preceding step S125 (hereinafter referred to as a preceding total sum), is equal to or lower than a predetermined threshold.

If it is determined in step S125 that the absolute value of the difference between the current total sum and the preceding total sum is not lower than the predetermined threshold, in other words, if the total sum changes greatly in response to the updating of the code vector $y_i$, the algorithm loops to step S123 to repeat the same process.

If it is determined in step S125 that the absolute value of the difference between the current total sum and the preceding total sum is equal to or lower than the predetermined threshold, in other words, if the total sum does not change or changes very little in response to the updating of the code vector $y_i$, the algorithm proceeds to step S126. The learning unit 125 determines whether the variable n representing the total number of the currently available code vectors equals N which is the number of code vectors set beforehand in the code book (hereinafter also referred to as the number of set code vectors).

If it is determined in step S126 that the variable n is not equal to the number N of the set code vectors, in other words, if it is determined that the number of available code vectors $y_i$ is not equal to the number N of the set code vectors, the algorithm loops to step S122. The above process is then repeated.

If it is determined in step S126 that the variable n is equal to the number N of the set code vectors, in other words, if it is determined that the number of available code vectors $y_i$ is equal to the number N of the set code vectors, the code book generator 215 outputs a code book formed of N code vectors $y_i$ as the quality-enhancement data, thereby ending the learning process.

Figure 23:
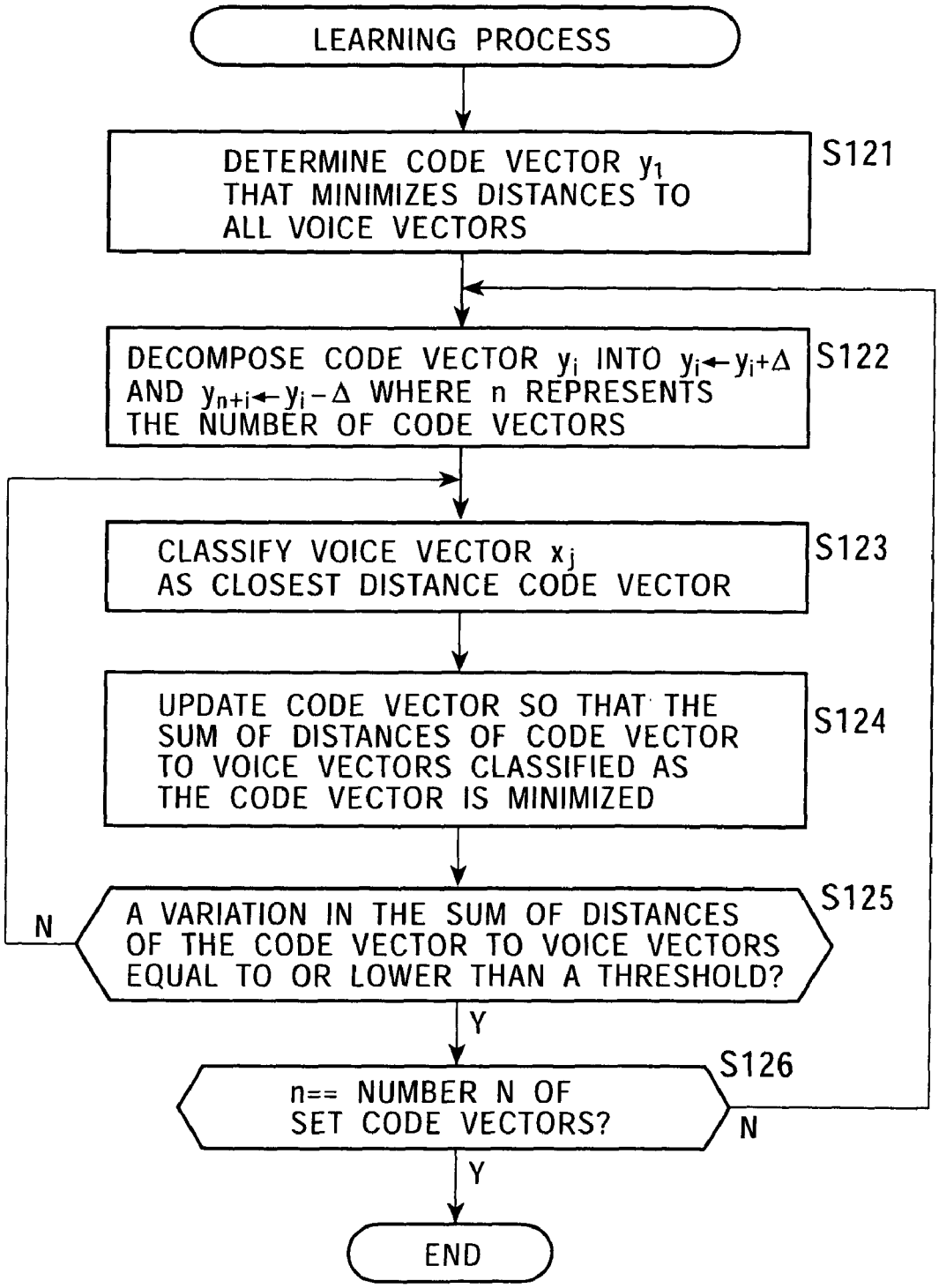
FIG. 23 is a flow diagram illustrating a learning process of the learning unit 125 wherein the encoder 123 performs vector quantization.

In the learning process illustrated in FIG. 23, the user vector memory 213 stores the voice vectors input until now and updates (generates) the code book using the voice vectors. The updating of the code book may be performed using the currently input voice vector and the already obtained code book in accordance with the process in steps S123 and S124, namely, in a simplified way, rather than using the voice vectors input in the past.

In this case, in step S123, the code book generator 215 classifies the voice vector $x_j$ (j=1, 2, . . . , J (the total number of currently input voice vectors)) as the code vector $y_i$ (i=1, 2, . . . , N (the total number of code vectors in the code book)) closest in distance to the voice vector $x_j$, and then the algorithm proceeds to step S124.

In step S124, the code book generator 215 updates the code vector $y_i$ so that the sum of distances to the voice vectors classified as the code vector $y_i$ is minimized. This updating process may be carried out by determining the center of gravity of points to which zero or more voice vectors classified for the code vector $y_i$ point. Let $y_i'$ represent the updated code vector, $x_1, x_2, \ldots, x_{M-L}$ represent the voice vectors input in the past and classified for the code vector $y_i$ prior to the updating process, $x_{M-L+1}, x_{M-L+2}, \ldots, x_M$ represent current voice vectors classified for the code vector $y_i$, and the code vector $y_i$ prior to the updating process and the code vector $y_i'$ subsequent to the updating process are determined by calculating equations (14) and (15).

$$y_i=(x_1+x_2+\ldots X_{M-L})/(M-L) \tag{14}$$

$$y_i'=(x_1+x_2+\ldots+x_{M-L}+x_{M-L+1}+x_{M-L+2}+\ldots+x_M)/M \tag{15}$$

The voice vectors $x_1, x_2, \ldots, x_{M-L}$ input in the past are not stored. Equation (15) is modified as below.

$$\begin{aligned} y_i' &= (x_1+x_2+\ldots+x_{M-L}+x_{M-L+1})/M + \\ &\quad (x_{M-L+2}+\ldots+x_M)/M \\ &= (x_1+x_2+\ldots+x_{M-L}+x_{M-L+1})/(M-L)\times(M-L)/M + \\ &\quad (x_{M-L+2}+\ldots+x_M)/M \end{aligned} \tag{16}$$

If equation (14) is substituted for equation (16), the following equation results.

$$y_i'=y_i x(M-L)/M+(x_{M-L+2}+\ldots+x_M)/M \tag{17}$$

From equation (17), the code vector $y_i$ is updated using the currently input voice vectors $x_{M-L+1}, x_{M-L+2}, \ldots, x_M$ and the code vector $y_i$ in the already obtained code book, and the updated code vector $y_i$ is thus determined.

Since there is no need to store the voice vectors input in the past, a small-capacity user vector memory 213 works. The user vector memory 213 must store the total number of voice vectors classified for each code vector $y_i$ until now, besides the currently input voice vectors. Along with the updating of the code vector $y_i$, the user vector memory 213 must update the total number of voice vectors classified for the updated code vector $y_i'$. The initial vector memory 214 must store the code book which is formed of an unspecified number of voice vectors, and the total number of voice vectors classified for each code vector, but not the unspecified number of voice vectors themselves. When the learning unit 125 illustrated in FIG. 22 performs the learning process for the first time or performs the learning process immediately subsequent to the clearance of the user vector memory 213, code book updating is performed using the code book stored in the initial vector memory 214.

The learning unit 125 in the embodiment illustrated in FIG. 22 performs the learning process illustrated in FIG. 23 on the newly input voice data and the voice data used in the past learning process during the voice communication or at any timing. As the user performs voice communication more, the code book more appropriate for the user, namely, the code book that reduces the quantization error more with respect to the voice of the user is obtained. By decoding the encoded voice data (namely, performing vector dequantization) using such a code book on the partner side, a process (the vector dequantization) appropriate for the characteristics of the voice of the user is performed. In comparison with the conventional art (in which a code book obtained from the voice of the unspecified number of users is used), decoded voice data with quality thereof sufficiently improved results.

Figure 24:
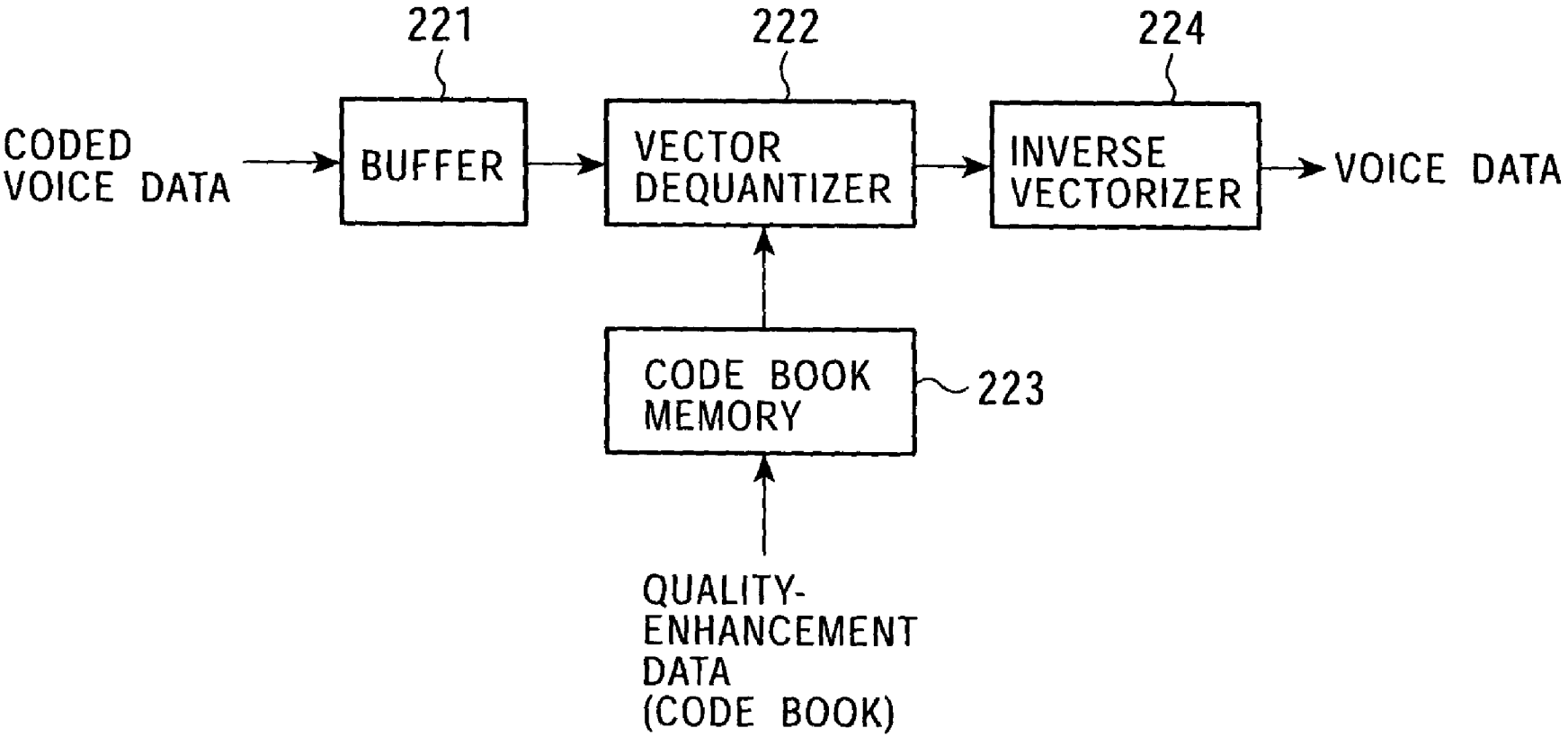
FIG. 24 is a block diagram illustrating the construction of the decoder 132 wherein the encoder 123 performs vector quantization.

FIG. 24 illustrates the construction of the decoder 132 in the receiver 114 (FIG. 4) wherein the learning unit 125 in the transmitter 113 (FIG. 3) is constructed as shown in FIG. 22.

A buffer 221 temporarily stores the encoded voice data (a code as a result of vector quantization) output from the receiver controller 131 (FIG. 4). A vector dequantizer 222 reads the code stored in the buffer 221, and performs vector dequantization referencing the code book stored in a code book memory 223. That code is thus decoded into a voice vector, which is then fed to an inverse-vectorizer 224.

The code book memory 223 stores the code book which is supplied by the management unit 135 as the quality-enhancement data.

The quality-enhancement data is the code book when the learning unit 125 in the transmitter 113 (FIG. 3) is constructed as shown in FIG. 22. The memory unit 136 in the receiver 114 (FIG. 4) thus stores the code book. The default data memory 137 in the receiver 114 stores, as default data, the code book which is generated using the voice vector stored in the initial vector memory 214 illustrated in FIG. 22.

The inverse-vectorizer 224 inverse-vectorizes the voice vector output from the vector dequantizer 222 into voice data in time scale.

Figure 25:
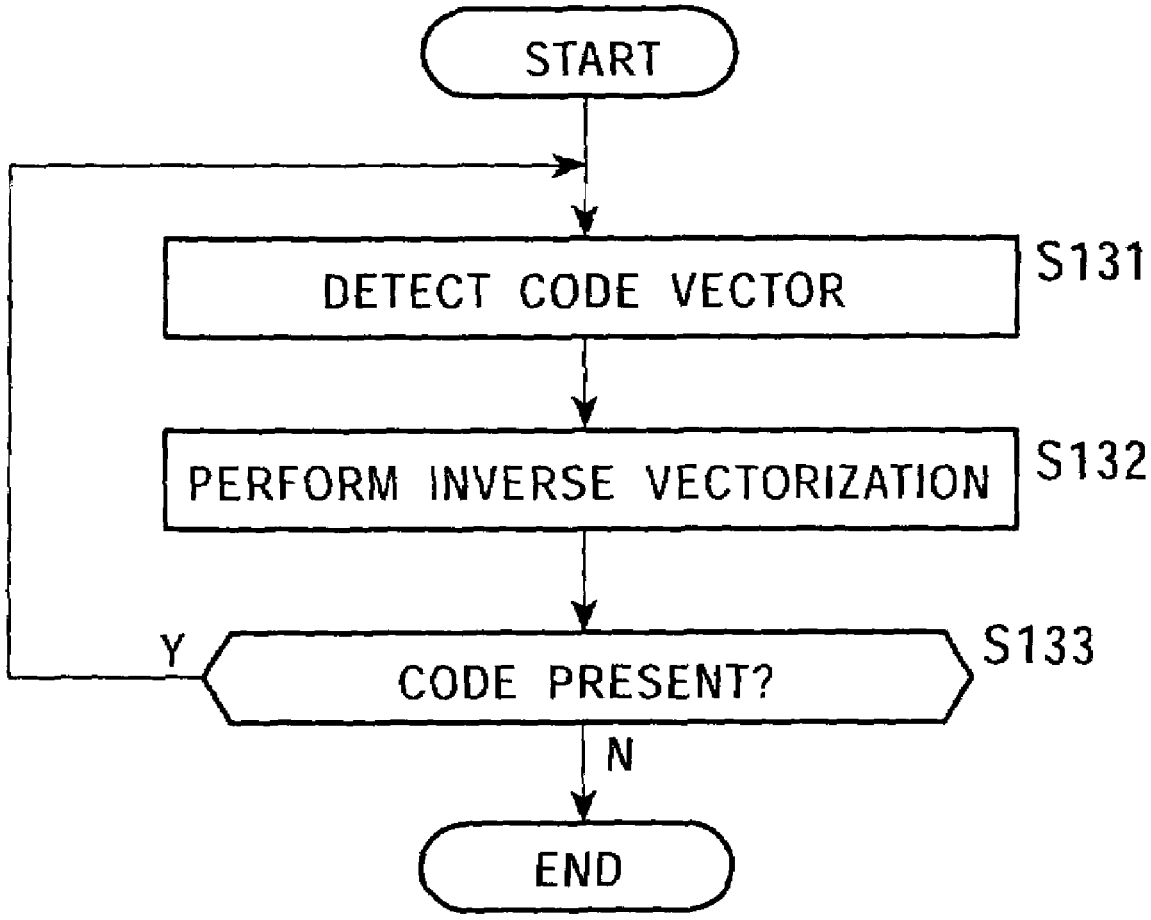
FIG. 25 is a flow diagram illustrating the process of the decoder 132 wherein the encoder 123 performs vector quantization.

The (decoding) process of the decoder 132 illustrated in FIG. 24 is discussed with reference to a flow diagram illustrated in FIG. 25.

The buffer 221 sequentially stores the encoded voice data in code fed thereto.

In step S131, the vector dequantizer 222 reads, as a target code, one code, which is old and not yet read, out of the codes stored in the buffer 221, and vector-dequantizes that code. Specifically, the vector dequantizer 222 detects a code vector correspondingly associated with the target code, out of the code vectors in a code book stored in the code book memory 223, and outputs the code vector as a voice vector to the inverse-vectorizer 224.

In step S132, the inverse-vectorizer 224 inverse-vectorizes the voice vector from the vector dequantizer 222, thereby outputting decoded voice data. The algorithm then proceeds to step S133.

In step S133, the vector dequantizer 222 determines whether a code not yet set as a target code is present in the buffer 221. If it is determined in step S133 that a code not yet set as a target code is present in the buffer 221, the algorithm loops to step S131. The vector dequantizer 222 sets, as a new target code, one code, which is old and not yet read, out of the codes stored in the buffer 221, and then repeats the same process.

If it is determined in step S133 that a code not yet set as a target code is not present in the buffer 221, the algorithm ends.

The above series of process steps is performed using hardware. Alternatively, these process steps may be performed using software programs. When the process steps are performed using a software program, a software program may be installed in a general-purpose computer.

Figure 26:
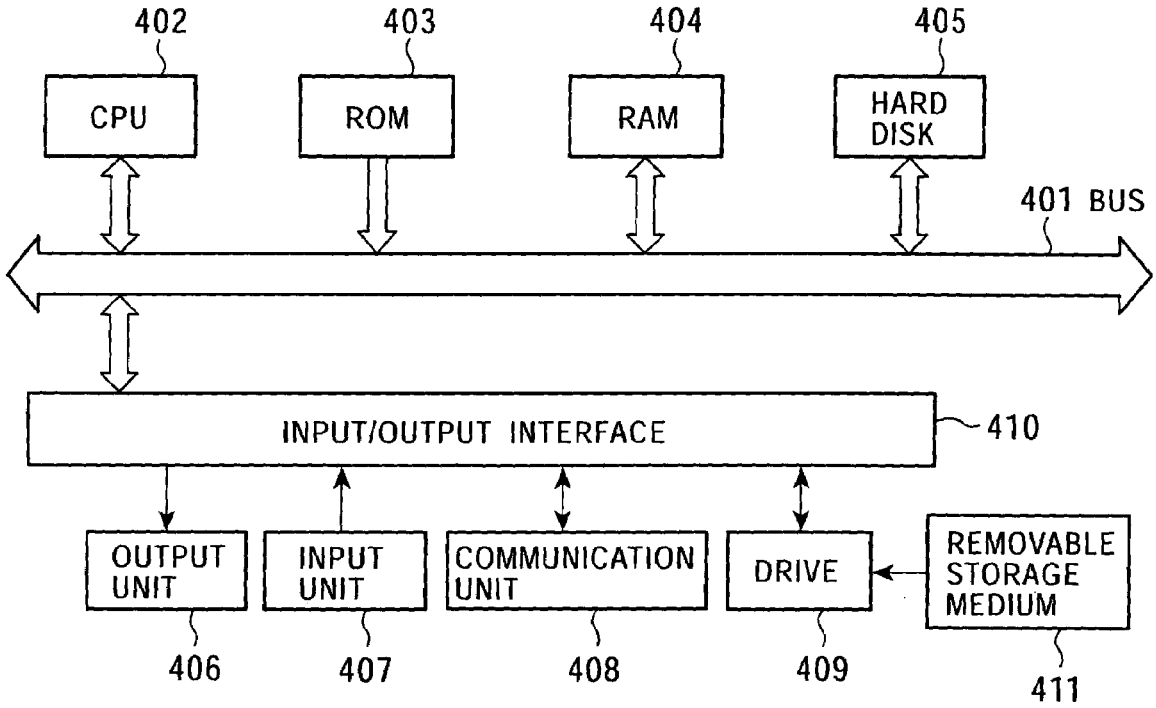
FIG. 26 is a block diagram illustrating the construction of one embodiment of a computer implementing the present invention.

FIG. 26 illustrates one embodiment of a computer in which the program for performing a series of process steps is installed.

The program may be stored beforehand in a hard disk 405 or a ROM 403 as a storage medium built in the computer.

Alternatively, the program may be temporarily or permanently stored in a removable storage medium 411, such as a flexible disk, CD-ROM (Compact Disk Read-Only Memory), MO (Magneto-optical) disk, DVD (Digital Versatile Disk), magnetic disk, or semiconductor memory. The removable storage medium 411 may be supplied in a so-called packaged software.

The program may be installed in the computer using the removable storage medium 411. Alternatively, the program may be radio transmitted to the computer from a down-load site via an artificial satellite for digital broadcasting, or may be transferred to the computer in a wired fashion using a network such as a LAN (Local Area Network) or the Internet. The computer receives the program at a communication unit 408, and installs the program in the built-in hard disk 405.

The computer contains a CPU (Central Processing Unit) 402. An input/output interface 410 is connected to the CPU 402 through a bus 401. The CPU 402 carries out the program stored in the ROM (Read-Only Memory) 403 when the CPU 402 receives a command from a user through the input/output interface 410 when the user operates an input unit 407 such as a keyboard, mouse, or microphone. The CPU 402 carries out the program by loading on a RAM (Random Access Memory) 404, the program stored in the hard disk 405, the program transmitted via a satellite or a network, received by the communication unit 408, and installed onto the hard disk 405, or the program read from the removable storage medium 411 loaded into a drive 409 and installed onto the hard disk 405. The CPU 402 carries out the process in accordance with each of the above-referenced flow diagrams, or the process carried out by the arrangement illustrated in the above-referenced block diagrams. The CPU 402 outputs the results of the process from an output unit 406 such as a LCD (Liquid-Crystal Display) or a loudspeaker through the input/output interface 410, or transmits the results of the process through the communication unit 408, or stores the results of the process onto the hard disk 405.

It is not a requirement that the process steps describing the program for causing the computer to carry out a variety of processes be carried out in a sequential order in time scale described in the flow diagrams. The process steps may be performed in parallel or separately (for example, parallel processing or processing using an object).

The program may be executed by a single computer, or by a plurality of computers in distributed processing. The program may be transferred to and executed by a computer at a remote place.

In the above-referenced embodiments, the called side uses the telephone number transmitted from the calling side during the arrival of a call as the identification information identifying the calling side. A unique ID (identification) may be assigned to a user, and that ID may be transmitted as identification information.

In the above-referenced embodiments, the present invention is applied to the system in which mobile telephones perform voice communication. The present invention finds widespread use in any system in which a voice communication is performed.

In the embodiment illustrated in FIG. 4, the memory unit 136 and the default data memory 137 may be constructed of a single rewritable memory.

The quality-enhancement data may be uploaded to an unshown server from the mobile telephone $\mathbf{101}_1$, and the mobile telephone $\mathbf{101}_2$ may download the quality-enhancement data as necessary.

INDUSTRIAL APPLICABILITY

In the transmitter, the transmitting method, and the first program in accordance with the present invention, the voice data is encoded, and the encoded voice data is output. The quality-enhancement data, which improves the quality of the voice output on the receiving side that receives the encoded voice data, is learned based on the voice data used in the past learning and the newly input voice data. The encoded voice data and the quality-enhancement data are then transmitted. The receiving side provides a high-quality decoded voice.

In the receiver, the receiving method, and the first program in accordance with the present invention, the encoded voice data is received, and the quality-enhancement data correspondingly associated with the identification information of the transmitting side that has transmitted the encoded voice data is selected. Based on the selected quality-enhancement data, the received encoded voice data is decoded. The decoded voice is high in quality.

In the transceiver of the present invention, the input voice data is encoded, and the encoded voice data is output. The quality-enhancement data, which improves the quality of the voice output on the other transceiver that receives the encoded voice data, is learned based on the voice data used in the past learning and the newly input voice data. The encoded voice data and the quality-enhancement data are then transmitted. The encoded voice data transmitted from the other transceiver is received. The quality-enhancement data correspondingly associated with the identification information of the other transceiver that has transmitted the encoded voice data is selected. Based on the selected quality-enhancement data, the received encoded voice data is decoded. The decoded voice is high in quality.

The invention claimed is:

1. A transmitter for transmitting input voice data, comprising:

encoder means for encoding the voice data and for outputting encoded voice data;

learning means for learning quality-enhancement data that improves the quality of a voice output on a receiving side that receives the encoded voice data, based on voice data that is used in past learning and newly input voice data; and transmitter means for transmitting the encoded voice data and the quality-enhancement data, wherein the learning means performs a learning process to determine, as the quality-enhancement data, a tap coefficient used together with decoded voice data to perform prediction calculation of a predictive value of high-quality data which is a high-quality version of the voice data decoded from encoded voice data.

2. The transmitter according to claim 1, wherein the learning means comprises:

low-quality data generator means for generating second data lower in quality than first data, the first data being the voice data; and calculator means for calculating the tap coefficient that statistically minimizes a predicted error between the first data and a predictive value of the first data which is obtained by performing the prediction calculation of the tap coefficient and the second data.

3. A transmitter according to claim 2, wherein the low-quality data generator means encodes the first data into the encoded voice data, and generates the second data which is obtained by decoding the encoded voice data.

4. The transmitter according to claim 2, wherein the learning means comprises:

class tap generator means for generating a class tap which is used to classify first target data which is the first data targeted; and class classifier means for classifying the first target data according to the class tap to determine the class of the first target data; and wherein the calculator means determines the tap coefficient for each class.

5. A receiver for receiving encoded voice data, comprising:

receiver means for receiving the encoded voice data;

storage means for storing quality-enhancement data, which improves decoded voice data that is obtained by decoding the encoded voice data, with identification information that identifies a transmitting side that has transmitted the encoded voice data;

selector means for selecting the quality-enhancement data associated with the identification information of the transmitting side that has transmitted the encoded voice data; and decoder means for decoding the encoded voice data received by the receiver means, based on the quality-enhancement data selected by the selector means wherein the quality-enhancement data is a tap coefficient used with the decoded voice data to perform prediction calculation of a predictive value of high-quality data which is a high-quality version of the voice data decoded from the encoded voice data, and wherein the decoder means comprises:

first processing means for decoding the encoded voice data and for outputting decoded voice data; and second processing means for determining a predictive value of the high-quality data by performing prediction calculation using the decoded voice data dad the tap coefficient.

6. A receiver according to claim 5, wherein the tap coefficient is determined by generating second data lower in quality than first data, the first data being the voice data, and by calculating the tap coefficient that statistically minimizes a predicted error between the first data and a predictive value of the first data which is obtained by performing the prediction calculation of the tap coefficient and the second data.

7. A receiver according to claim 6, wherein the second data is decoded voice data that is obtained by encoding the first data into the encoded voice data, and by decoding the encoded voice data.

8. The receiver according to claim 5, wherein the tap coefficients are classified according to a predetermined class, and wherein the second processing means comprises:

class tap generator means for generating a class tap used to classify target data which is the high-quality voice data, the predictive value of which is determined;

class classifier means for classifying the target data according to the class tap to determine the class of the target data; and predicting means for determining the predictive value of the target data by performing prediction calculation using the tap coefficient corresponding to the class of the target data and the decoded voice data.

* * * * *